US007673408B2

(12) United States Patent
Hess et al.

(10) Patent No.: US 7,673,408 B2
(45) Date of Patent: Mar. 9, 2010

(54) FLAME SIMULATING ASSEMBLY

(75) Inventors: Kristoffer Hess, Cambridge (CA); Kelly Stinson, Kitchener (CA)

(73) Assignee: Dimplex North America Limited, Cambridge, ON (CA)

( * ) Notice: Subject to any disclaimer, the term of this patent is extended or adjusted under 35 U.S.C. 154(b) by 631 days.

(21) Appl. No.: 11/609,027

(22) Filed: Dec. 11, 2006

(65) Prior Publication Data

US 2007/0094903 A1 May 3, 2007

Related U.S. Application Data

(63) Continuation-in-part of application No. 10/759,143, filed on Jan. 20, 2004, now Pat. No. 7,162,820.

(51) Int. Cl.
*G09F 19/00* (2006.01)

(52) U.S. Cl. ..... 40/428; 40/219

(58) Field of Classification Search ..... 40/428, 40/219

See application file for complete search history.

(56) References Cited

U.S. PATENT DOCUMENTS

| | | | |
|---|---|---|---|
| 1,514,552 | A | 11/1924 | McCormick |
| 1,531,171 | A | 3/1925 | Berry et al. |
| 1,586,597 | A | 6/1926 | Berry |
| 1,719,622 | A | 7/1929 | Price |
| 1,768,284 | A | 6/1930 | Berry |
| 1,809,164 | A | 6/1931 | Gritt |
| 1,824,388 | A | 9/1931 | Birch |
| 1,827,941 | A | 10/1931 | Gross |
| 1,843,279 | A | 2/1932 | Gritt |
| 1,901,294 | A | 3/1933 | Gritt et al. |
| 2,285,535 | A | 6/1942 | Schlett |
| 2,286,246 | A | 6/1942 | Yearta |
| 2,708,114 | A | 5/1955 | Hancock |
| 2,963,807 | A | 12/1960 | Relph et al. |
| 3,119,371 | A | 1/1964 | Zuckerman |

(Continued)

FOREIGN PATENT DOCUMENTS

| | | |
|---|---|---|
| EP | 0 348 137 | 12/1989 |
| EP | 0 611 921 | 8/1994 |
| EP | 1 020 685 | 7/2000 |

(Continued)

OTHER PUBLICATIONS

Cross-referencing: Claims as filed from U.S. Appl. No. 11/622,771 which is also a C-I-P of the same parent application (U.S. Appl. No. 10/759,143, now Patent No. 7,162,820).

Cross-referencing: Claims as allowed in parent application, Patent No. 7,162,820.

*Primary Examiner*—Gary C Hoge

(57) ABSTRACT

An assembly including a substantially transparent front panel and a partially translucent screen with a partially reflective front surface positioned to face a rear side of the front panel and spaced apart therefrom by a predetermined distance. A first image is defined on the rear side for reflection by the front surface to provide a virtual image thereof. A back wall is positioned behind the screen and displays a second image on an exposed surface thereof facing the rear surface of the screen. The exposed surface is spaced apart from the front surface of the screen by the predetermined distance. The virtual image is located substantially in the plane of the exposed surface so that the virtual image appears to be positioned behind the screen.

21 Claims, 27 Drawing Sheets

U.S. PATENT DOCUMENTS

| | | | |
|---|---|---|---|
| 3,395,475 | A | 8/1968 | Moss |
| 3,395,476 | A | 8/1968 | Moss et al. |
| 3,445,948 | A | 5/1969 | Moss et al. |
| 3,603,013 | A | 9/1971 | Reed et al. |
| 3,694,945 | A | 10/1972 | Detiker |
| 3,699,697 | A | 10/1972 | Painton |
| 3,742,189 | A | 6/1973 | Conroy et al. |
| 3,978,598 | A | 9/1976 | Rose et al. |
| 4,026,544 | A | 5/1977 | Plambeck et al. |
| 4,573,905 | A | 3/1986 | Meyers |
| 4,673,609 | A | 6/1987 | Hill |
| 4,883,043 | A | 11/1989 | Thow et al. |
| 4,890,600 | A | 1/1990 | Meyers |
| 4,925,705 | A | 5/1990 | Hill |
| 4,965,707 | A | 10/1990 | Butterfield |
| 5,195,820 | A | 3/1993 | Rehberg |
| 5,278,595 | A | 1/1994 | Nishida et al. |
| 5,291,297 | A | 3/1994 | Steinmeyer |
| 5,525,177 | A | 6/1996 | Ross |
| 5,642,580 | A | 7/1997 | Hess et al. |
| 5,648,827 | A | 7/1997 | Shaw |
| 5,743,038 | A | 4/1998 | Soto |
| 5,787,618 | A | 8/1998 | Mullis |
| 6,047,489 | A | 4/2000 | Hess et al. |
| 6,050,011 | A | 4/2000 | Hess et al. |
| 6,190,019 | B1 | 2/2001 | Hess |
| 6,269,567 | B1 | 8/2001 | MacPherson et al. |
| 6,302,555 | B1 | 10/2001 | Bristow |
| 6,363,636 | B1 | 4/2002 | Hess et al. |
| 6,385,881 | B1 | 5/2002 | Hess |
| 6,393,207 | B1 | 5/2002 | Martin et al. |
| 6,413,079 | B1 | 7/2002 | Lyons et al. |
| 6,461,011 | B1 | 10/2002 | Harrison |
| 6,564,485 | B1 | 5/2003 | Hess |
| 6,691,440 | B1 | 2/2004 | Petz et al. |
| 6,718,665 | B2 | 4/2004 | Hess et al. |
| 6,719,443 | B2 | 4/2004 | Gutstein et al. |
| 6,757,487 | B2 | 6/2004 | Martin et al. |
| 6,880,275 | B2 | 4/2005 | Mix et al. |
| 6,919,884 | B2 | 7/2005 | Mix et al. |
| 7,373,743 | B1 | 5/2008 | Hess |
| 2002/0023376 | A1 | 2/2002 | Hess |
| 2002/0139021 | A1 | 10/2002 | Hess et al. |
| 2002/0168182 | A1 | 11/2002 | Martin et al. |
| 2002/0170215 | A1 | 11/2002 | Mix et al. |
| 2002/0175215 | A1 | 11/2002 | Webster et al. |
| 2003/0046837 | A1 | 3/2003 | Hess |
| 2003/0072565 | A1 | 4/2003 | Ravnbo-West et al. |
| 2003/0110671 | A1 | 6/2003 | Hess |
| 2003/0126775 | A1 | 7/2003 | Corry et al. |
| 2003/0156828 | A1 | 8/2003 | Jamieson et al. |
| 2004/0060213 | A1 | 4/2004 | Schroeter et al. |
| 2004/0114351 | A1 | 6/2004 | Stokes |
| 2004/0173202 | A1 | 9/2004 | Lyons et al. |
| 2004/0181983 | A1 | 9/2004 | Hess et al. |
| 2004/0255931 | A1 | 12/2004 | Bachinski et al. |
| 2004/0264949 | A1 | 12/2004 | Deng |
| 2005/0063685 | A1 | 3/2005 | Bristow |
| 2005/0072031 | A1 | 4/2005 | Hess et al. |
| 2005/0086841 | A1 | 4/2005 | Schroeter et al. |
| 2005/0097792 | A1 | 5/2005 | Naden |
| 2005/0097793 | A1 | 5/2005 | Hess |
| 2005/0155262 | A1 | 7/2005 | Mix et al. |
| 2005/0252051 | A1 | 11/2005 | Chen |
| 2006/0026894 | A1 | 2/2006 | Hess et al. |
| 2006/0101681 | A1 | 5/2006 | Hess et al. |
| 2006/0153547 | A1 | 7/2006 | O'Neill |
| 2006/0162198 | A1 | 7/2006 | Hess et al. |
| 2006/0188831 | A1 | 8/2006 | Hess et al. |
| 2006/0242870 | A1 | 11/2006 | Atemboski et al. |
| 2007/0107280 | A1 | 5/2007 | Stinson et al. |
| 2007/0224561 | A1 | 9/2007 | Hess et al. |

FOREIGN PATENT DOCUMENTS

| | | |
|---|---|---|
| EP | 1 199 524 | 4/2002 |
| EP | 1 271 060 | 1/2003 |
| EP | 1 439 351 | 7/2004 |
| EP | 04 25 0277 | 2/2006 |
| GB | 272836 | 6/1927 |
| GB | 322688 | 12/1929 |
| GB | 397594 | 8/1933 |
| GB | 414280 | 8/1934 |
| GB | 426887 | 4/1935 |
| GB | 957591 | 5/1964 |
| GB | 968568 | 9/1964 |
| GB | 975009 | 11/1964 |
| GB | 978364 | 12/1964 |
| GB | 978365 | 12/1964 |
| GB | 1088577 | 1/1966 |
| GB | 1024047 | 3/1966 |
| GB | 1097812 | 1/1968 |
| GB | 1186655 | 4/1970 |
| GB | 1266131 | 3/1972 |
| GB | 1272644 | 5/1972 |
| GB | 1407926 | 10/1975 |
| GB | 1443772 | 7/1976 |
| GB | 1567625 | 5/1980 |
| GB | 2032417 | 5/1980 |
| GB | 2118096 | 10/1983 |
| GB | 2137336 | 10/1984 |
| GB | 2151772 | 7/1985 |
| GB | 2180927 | 4/1987 |
| GB | 2210969 | 6/1989 |
| GB | 2222000 | 2/1990 |
| GB | 2230335 | 10/1990 |
| GB | 2240171 | 7/1991 |
| GB | 2242737 | 10/1991 |
| GB | 2251935 | 7/1992 |
| GB | 2261723 | 5/1993 |
| GB | 2264555 | 9/1993 |
| GB | 2267563 | 12/1993 |
| GB | 2275105 | 8/1994 |
| GB | 2276444 | 9/1994 |
| GB | 2288052 | 10/1995 |
| GB | 2290374 | 12/1995 |
| GB | 2290865 | 1/1996 |
| GB | 2298073 | 8/1996 |
| GB | 2302172 | 1/1997 |
| GB | 2302730 | 1/1997 |
| GB | 2307132 | 5/1997 |
| GB | 2315543 | 2/1998 |
| GB | 2321700 | 8/1998 |
| GB | 2325733 | 12/1998 |
| GB | 2350182 | 11/2000 |
| GB | 2372807 | 9/2002 |
| GB | 2379009 | 2/2003 |
| GB | 2387901 | 10/2003 |
| GB | 2404730 | 2/2005 |
| GB | 2408322 | 5/2005 |
| GB | 2409323 | 6/2005 |
| GB | 2418984 | 4/2006 |
| GB | 2427021 | 12/2006 |
| WO | 99/04536 | 9/1999 |
| WO | 01/57447 | 8/2001 |
| WO | 2004/027321 | 4/2004 |
| WO | 2004/109189 | 12/2004 |
| WO | 2005/028962 | 3/2005 |
| WO | 2005/078350 | 8/2005 |
| WO | 2006/027272 | 3/2006 |
| WO | 2006/027273 | 3/2006 |
| WO | 2006/040167 | 4/2006 |
| WO | WO 2006/040342 | 4/2006 |
| WO | 2008/149117 | 12/2008 |

FLAME SIMULATING ASSEMBLY

This application is a continuation-in-part of prior application Ser. No. 10/759,143, filed Jan. 20, 2004.

FIELD OF THE INVENTION

The present invention relates to a flame simulating assembly adapted for displaying an image of flames.

BACKGROUND OF THE INVENTION

Various types of flame simulating assemblies are known. Often, a flame simulating assembly is designed to be included in an electric fireplace, to simulate a fire in a real fireplace. For example, U.S. Pat. No. 4,965,707 (Butterfield) discloses a simulated flame system for an electric fireplace in which a light source is combined with billowing ribbons to simulate flames. The effect resulting tends to resemble flames from a coal fuel source more than flames from a wood fuel source. The flames for burning wooden logs tend to be more active and extend higher above the fuel source.

Known flame simulating assemblies have certain advantages over actual fireplaces, in which a combustible fuel (usually wood or coal, or natural gas) can be burned. Among other things, electric flame simulating assemblies can be used in an interior room (such as in a condominium building or a hotel) from which access to a chimney (i.e., for an actual fireplace) would be difficult. Also, and in particular, known flame simulating assemblies usually occupy less space than actual fireplaces.

The relatively narrow configurations of known flame simulating assemblies is one of their advantages, as noted above. However, known flame simulating assemblies typically have somewhat less depth (i.e., distance from front to back) than ordinary fireplaces. Due to this, the overall effect presented by these flame simulating assemblies is often not as realistic as may be desirable. This is because the relatively smaller depth of the typical flame simulating assembly, as compared to the usual depth of a real fireplace, tends to undermine the overall simulation effect sought with the typical flame simulating assembly.

There is therefore a need for an improved flame simulating assembly adapted for displaying an image of flames.

SUMMARY OF THE INVENTION

In a broad aspect of the present invention, there is provided an assembly including a substantially transparent front panel having a rear side and a front side opposed thereto and a partially translucent screen with a partially reflective front surface and a rear surface opposed thereto. The front surface is positioned to face the rear side of the front panel and spaced apart therefrom by a predetermined distance. The front surface of the screen is positioned substantially parallel to the rear side of the front panel. The assembly also includes a plurality of first dots disposed on the front panel in a sufficiently consistent density over a given area to produce a substantially uniform tinted appearance to the front panel when observed through the front side. In addition, the assembly includes a plurality of second dots disposed on the first dots and facing the front surface of the screen. The second dots are smaller than the first dots. The second dots define a first image for reflection by at least part of the front surface of the screen to provide a virtual image of the first image. The assembly also includes a back wall positioned behind the screen and displaying a second image on an exposed surface thereof facing the rear surface of the screen. The exposed surface is spaced apart from the front surface of the screen by the predetermined distance. Also, the exposed surface substantially defines a plane. The exposed surface of the back wall is positioned substantially parallel to the front surface of the screen. In addition, the second image is at least partially observable through the front side of the front panel. The virtual image is located substantially in the plane of the exposed surface, so that the virtual image appears to be positioned behind the screen.

In another aspect, the virtual image and the second image are substantially aligned (or congruent) with each other so that the virtual image and the second image appear to be substantially continuous relative to each other.

In another of its aspects, the assembly additionally includes a housing in which the screen is disposed, and the screen includes a top edge spaced apart from a top wall of the housing to define an upper opening so that the exposed surface is at least partially observable through the front side of the front panel and the upper opening.

In yet another aspect, the assembly additionally includes a flame image subassembly for providing one or more images of flames, and a simulated fuel bed positioned in front of the front surface of the screen. Also, the front surface includes a viewing region disposed proximate to the simulated fuel bed through which the image of flames is transmittable, and an observation region disposed distal to the simulated fuel bed. The observation region is adapted to permit at least partial observation of the back wall from the front side of the front panel.

In yet another of its aspects, the flame image subassembly includes a light source and a flicker element positioned in a path of light from the light source to the screen. The flicker element is for causing light from the light source to flicker (or fluctuate), like flickering (or fluctuating) light in a fire. The flame image subassembly also includes a flame effect element positioned in the path of light, for configuring light from the light source to form the images of flames.

In another aspect, the front surface of the screen includes a transition region disposed between the observation region and the viewing region. The exposed surface of the back wall is at least partially observable through the transition region.

In another of its aspects, the invention provides a flame simulating assembly for providing one or more images of flames. The flame simulating assembly includes a housing having a back wall with a substantially planar exposed surface, the housing defining a cavity open at a front end of the housing. A screen is disposed in the cavity and in front of the back wall. The screen has a front surface adapted for transmitting the images of flames therethrough. The front surface is at least partially reflective and positioned substantially parallel to the exposed surface of the back wall. The assembly also includes a flame image subassembly for providing the images of flames. A substantially transparent front panel is disposed substantially at the front end of the housing and has a front side and an opposed rear side thereof. The rear side of the front panel faces the front surface of the screen, and is spaced a predetermined distance apart from the front surface of the screen. In addition, the rear side of the front panel is positioned substantially parallel to the front surface of the screen. The front panel includes a plurality of first dots disposed on the front panel in a sufficiently constant density over a given area to produce a substantially uniform tinted appearance to the front panel when observed through the front side, and a plurality of second dots disposed on the first dots and facing the front surface of the screen. A first image is defined by the second dots. The first image is substantially invisible when observed through the front side other than as a virtual image thereof reflected by the front surface of the screen. Also, the exposed surface of the back wall displays a second image at least partially observable through the front side of the front panel, the exposed surface being spaced apart from the front surface of the screen by the predetermined distance. The virtual image is located substantially in the plane of the exposed surface so that the virtual image appears to be positioned behind the screen.

In another aspect, the first image and the second image are representations of a firebrick wall which are positioned so that the virtual image and the second image are substantially aligned with each other.

BRIEF DESCRIPTION OF THE DRAWINGS

The invention will be better understood with reference to the drawings, in which.

DETAILED DESCRIPTION OF THE PREFERRED EMBODIMENT(S)

Figure 1:
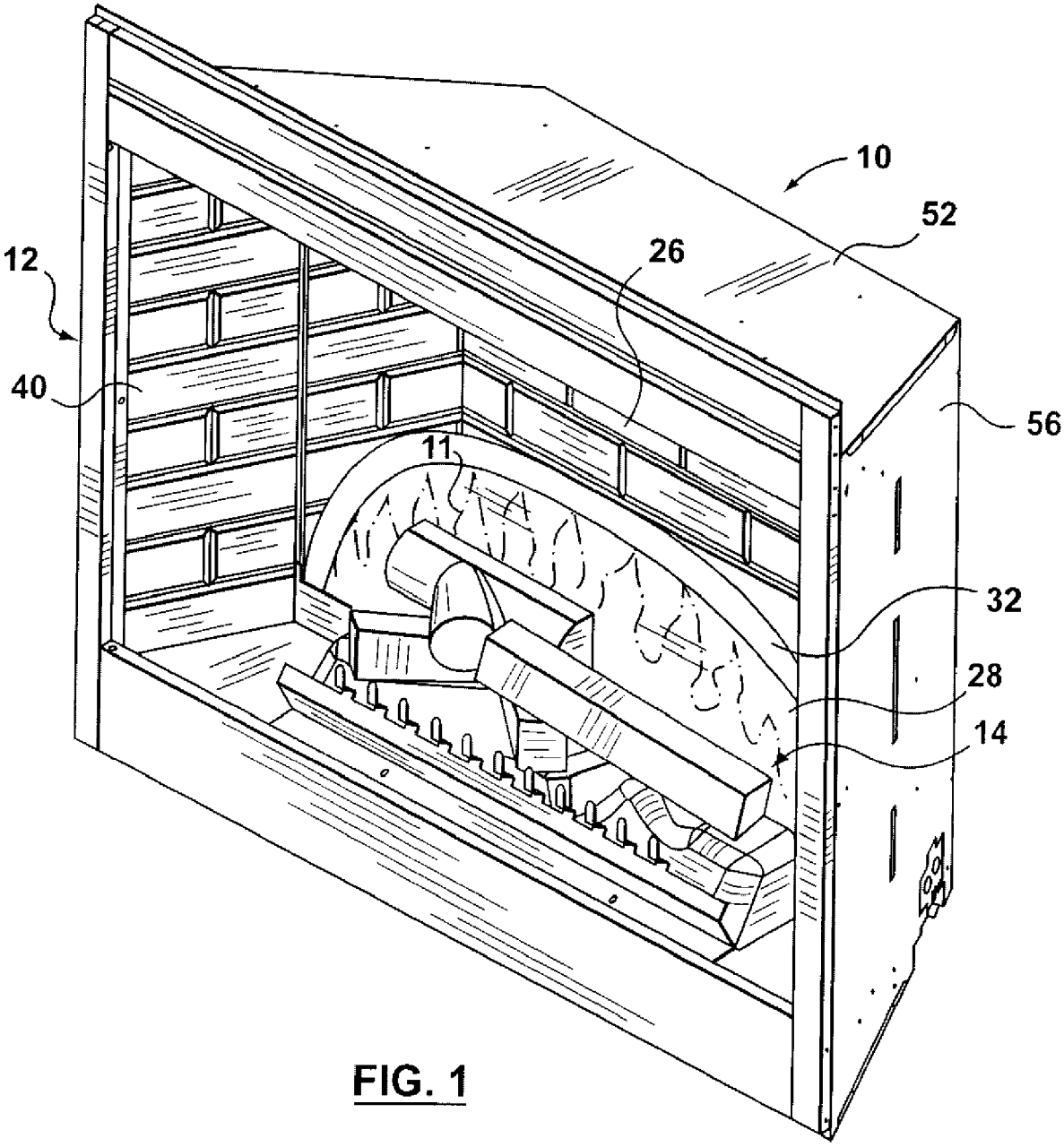
FIG. 1 is an isometric view of a preferred embodiment of the flame simulating assembly including a simulated fuel bed and a screen positioned behind the simulated fuel bed.
Figure 2A:
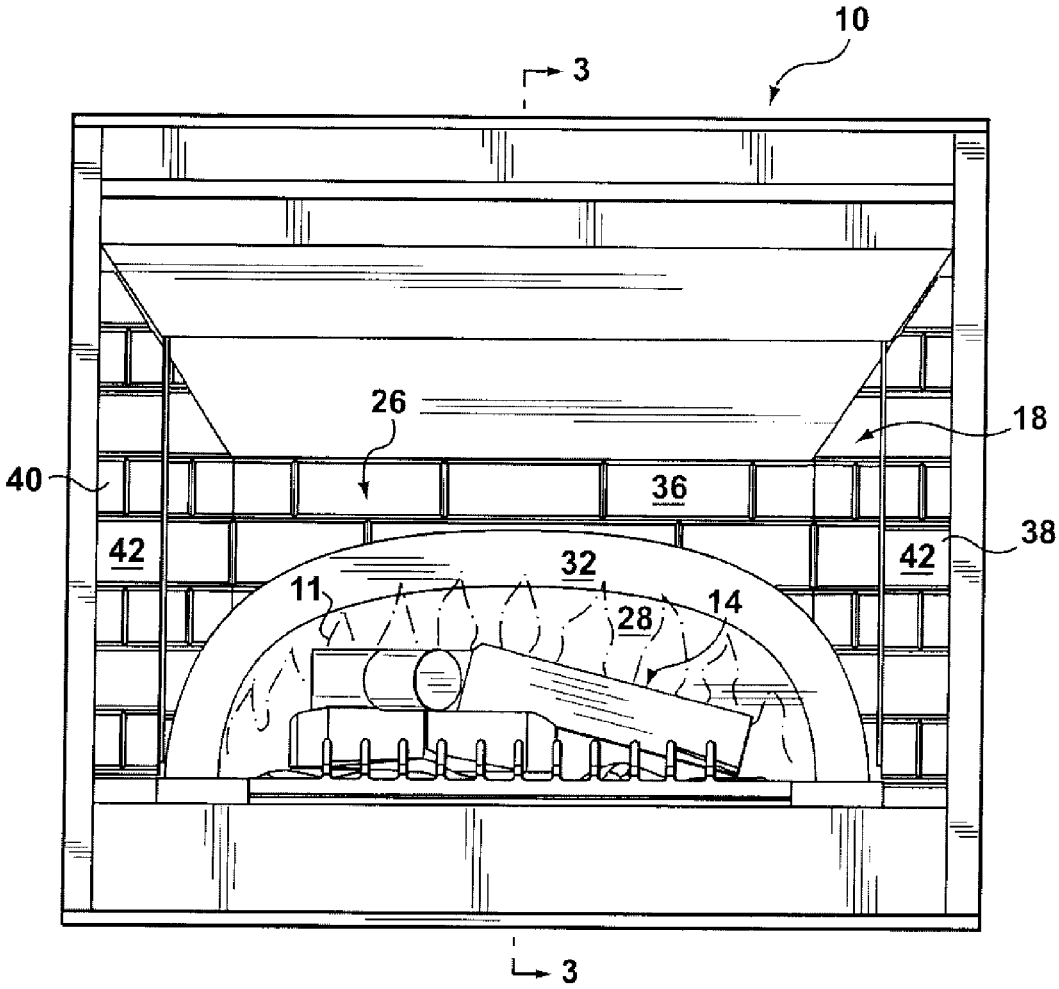
FIG. 2A is a front view of the flame simulating assembly of FIG. 1.
Figure 2B:
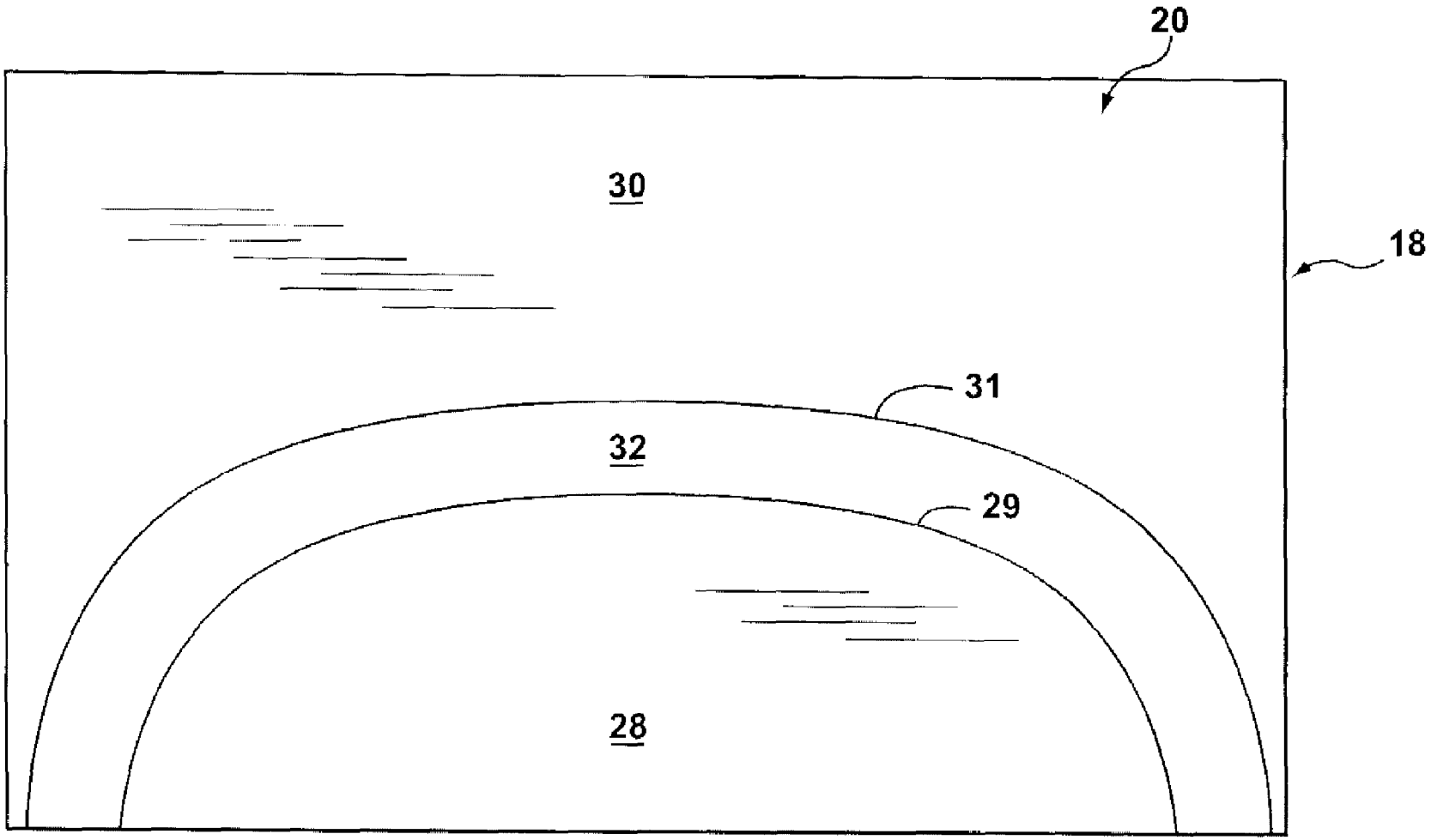
FIG. 2B is a front view of the screen.
Figure 2C:
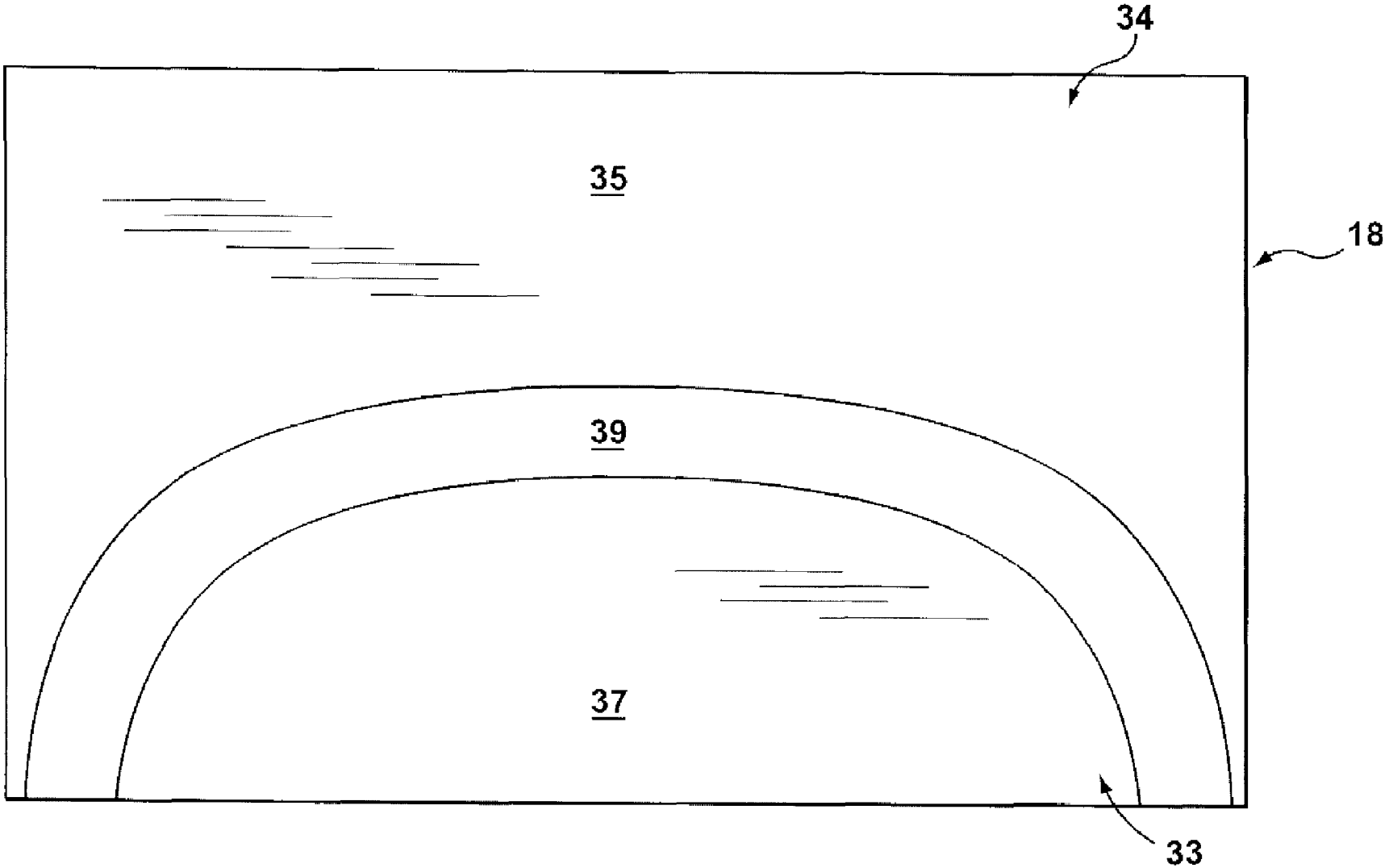
FIG. 2C is a back view of the screen.
Figure 3A:
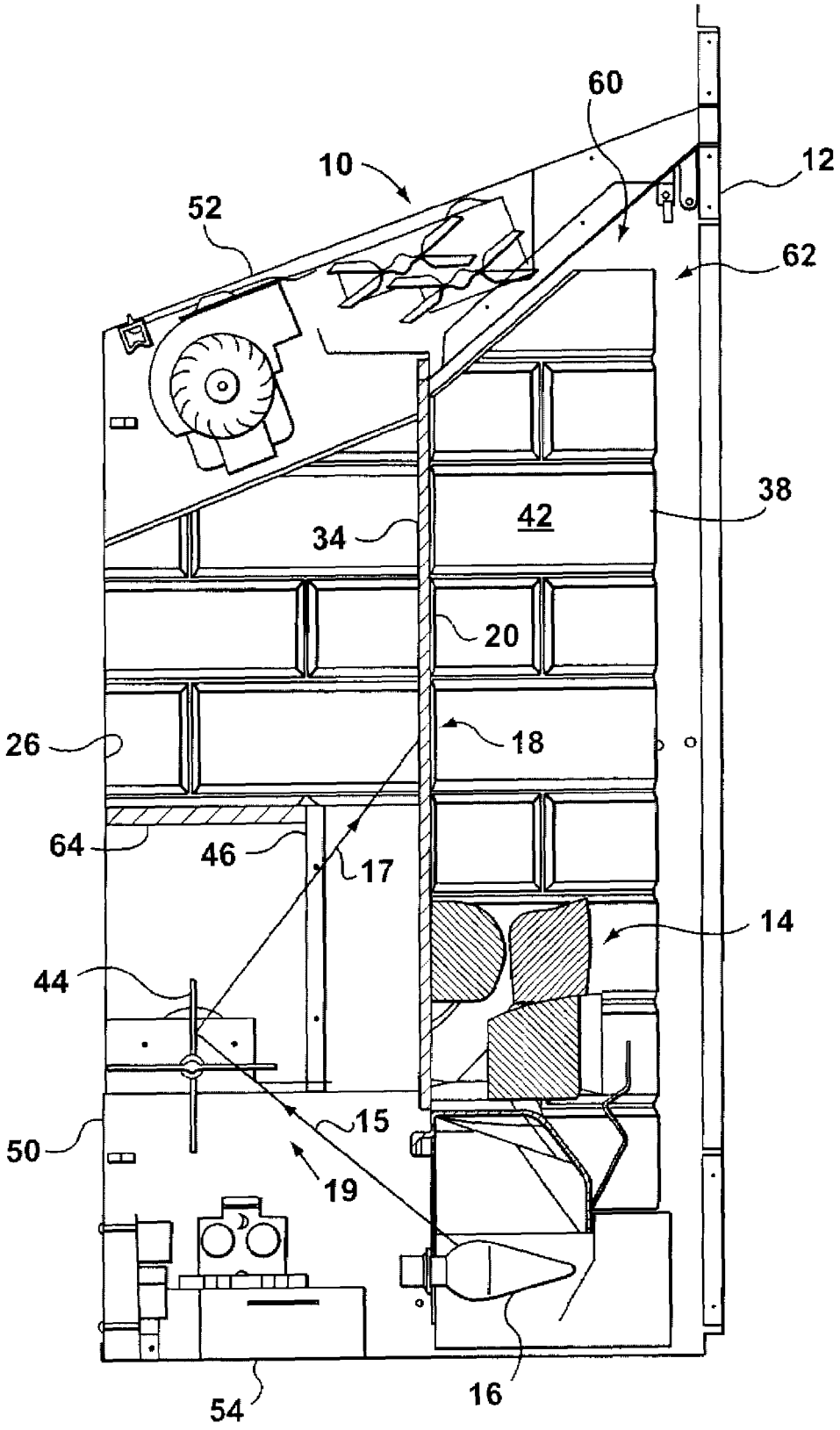
FIG. 3A is a cross section of the flame simulating assembly of FIG. 1 taken along line 3-3 in FIG. 2A, drawn at a larger scale.

Reference is first made to FIGS. 1, 2A, 2B, 2C and 3A to describe a preferred embodiment of a flame simulating assembly indicated generally by the numeral 10 in accordance with the invention. The flame simulating assembly 10 is for providing one or more images of flames 11 (FIGS. 1, 2A). Preferably, the flame simulating assembly 10 includes one or more light sources 16 for producing the images of flames 11, and a screen 18 positioned in a path of light 19 (schematically represented by arrows 15, 17 in FIG. 3A) from the light source. As can be seen in FIG. 3A, the screen 18 has a front surface 20. The screen 18 is adapted to transmit the images of flames 11 through the front surface 20. Preferably, the flame simulating assembly 10 also includes a simulated interior fireplace wall 26 which is positioned behind the screen 18, as can be seen in FIGS. 1, 2A, and 3A. In the preferred embodiment, the front surface 20 of the screen 18 includes an observation region 30 (FIGS. 2A, 2B). The observation region 30 is adapted to permit observation of at least part of the simulated interior fireplace wall 26. The front surface 20 of the screen 18 also includes a viewing region 28 (FIGS. 1, 2A, 2B).

For clarity, an image of flames 11 is illustrated in FIGS. 1, 2A, 4, and 5 in ghost outline. It will be understood that the image of flames is constantly changing (in shape and intensity of light, and color) while the flame simulating assembly 10 is operating.

As can be seen in FIGS. 1, 2A, and 3A, the flame simulating assembly 10 preferably includes a simulated fuel bed 14 which is positioned adjacent to the viewing region 28. In the preferred embodiment, the images of flames 11 are transmitted through the front surface 20 proximal to the simulated fuel bed 14, for a realistic flame simulation effect (FIGS. 1, 2A, 3A).

Preferably, the viewing region 28 is partially reflective. Because of this, the simulated fuel bed 14 is reflected in the viewing region 28 to an extent sufficient to provide an illusion of depth, as described in U.S. Pat. No. 5,642,580. U.S. Pat. No. 5,642,580 is hereby incorporated herein by reference. However, the images of flames 11 are also transmittable through the partially reflective viewing region 28. As can be seen in FIGS. 1 and 2A, the viewing region 28 is located proximal to the simulated fuel bed 14 so that, when images of flames 11 are transmitted through the screen 18, the images of flames 11 appear to be rising from and out of the simulated fuel bed 14, similar to flames in a real fire. At the same time, the simulated interior fireplace wall 26 is observable through an observation region 30, thereby simulating a firebox in a real fireplace (not shown) in which wood or coal may be burned. The observation region 30 is preferably transparent or translucent, or at least partially transparent or translucent.

In the preferred embodiment, the front surface 20 of the screen 18 also includes a transition region 32 disposed between the viewing region 28 and the observation region 30. Preferably, the images of flames 11 are at least partially transmittable through the transition region 32, and the simulated interior fireplace wall 26 is also at least partially observable through the transition region 32. The transition region 32 is for providing a relatively gradual transition from the viewing region 28 to the observation region 30, in order to provide a more realistic overall simulation effect. Preferably, if the viewing region 28 is partially reflective, then the transition region 32 is also partially reflective, however, to a somewhat lesser extent. To achieve this, the transition region 32 is preferably less silvered relative to the viewing region 28, as will be described.

In the preferred embodiment, the screen 18 additionally includes a back surface 34 positioned opposite to the front surface 20. Preferably, the back surface 34 is adapted to diffuse light transmitted through the screen 18 to prevent an observer (not shown) from observing the light source 16, or other internal components of the flame simulating assembly 10. Such a back surface 34 is described in U.S. Pat. No. 5,642,580. In the preferred embodiment of the flame simulating assembly 10, however, the back surface 34 of the screen 18 includes a diffusing portion 33 which is located substantially opposite to the viewing region 28 and the transition region 32 (FIG. 2C). The back surface 34 also includes a non-diffusing portion 35 which is located substantially opposite to the observation region 30 (FIG. 2C).

In the preferred embodiment, the diffusing portion 33 is divided into a first part 37, located opposite to the viewing region 28, and a second part 39, located opposite to the transition region 32. Preferably, the extent to which light is diffused by the second part 39 is somewhat less than the extent to which light is diffused by the first part 37. Because of this, the simulated interior fireplace wall 26 is at least partially observable through the transition region 32.

Preferably, the screen 18 is glass, plastic, or another other suitable material. In the preferred embodiment, the screen 18 is lightly silvered so that it is partially reflective, to provide a two-way mirror in the viewing region 28. The transition region 32 is preferably more lightly silvered. Within the transition region 32, the extent of reflective material on the front surface 20 varies from a relatively greater amount closer to the viewing region 28 to a relatively lesser amount closer to the observation region 30. This variation within the transition region 32 is for providing a gradual decrease in reflective material, from the viewing region 28 to the observation region 30, to enhance the simulation effect provided by the flame simulating assembly 10. The preferred method of producing the viewing region 28, the observation region 30, and the transition region 32 will be described.

Alternatively, however, the screen 18 could be suitably tinted or otherwise treated in any suitable manner to provide the described simulation effect. For example, the screen could be tinted (i.e., without silvering on the front surface 20) to provide the viewing region 28 and the transition region 32, so that the viewing region 28 is darker than the transition region 32. The observation region 30 could also be tinted or screened to achieve any desired effects, but still permitting relatively unobstructed observation therethrough.

An upper edge 29 of the viewing region 28 (which is also a lower edge 29 of the transition region 32), is shown in FIG. 2B. Also, an upper edge 31 of the transition region 32 (which is also a lower edge 31 of the observation region 30) is shown in FIG. 2B. It will be understood that, in the preferred embodiment, the regions 28, 32, and 30 are not sharply distinguished from each other. The edges 29, 31 are shown as clearly distinguished lines for illustrative purposes. In the preferred embodiment, the change from the viewing region 28 to the transition region 32 is gradual, and the change from the transition region 32 to the observation region 30 is also gradual.

It is also preferred that the simulated interior fireplace wall 26 has a pattern 36 simulating firebrick thereon (FIGS. 1, 2A, 3A). The firebrick pattern 36 preferably resembles firebrick in walls of a firebox in a real fireplace, and tends to enhance the overall simulation effect.

Preferably, the flame simulating assembly 10 also includes a flame effect element 46, for configuring light from the light source 16 to form the image of flames 11. The flame effect element 46 is positioned in the path of light 19 from the light source 16 between the light source 16 and the screen 18. The flame effect element 46 can include one or more apertures (not shown) passing through the apertures forming into the image of flames 11 (FIG. 3A). A similar flame effect element is described in U.S. Pat. No. 5,642,580 and in U.S. Pat. No. 6,363,636. U.S. Pat. No. 6,363,636 is hereby incorporated herein by reference.

In the preferred embodiment, the flame simulating assembly 10 also includes a flicker element 44 for causing light from the light source 16 to fluctuate, thereby enhancing the overall simulation effect. The flicker element 44 is positioned in the path of light 19 from the light source 16 between the light source 16 and the screen 18. Preferably, the flicker element 44 is similar to the flicker elements described in U.S. Pat. Nos. 5,642,580 and 6,363,636.

In the preferred embodiment, the flame simulating assembly 10 includes a housing 48 with a substantially vertical back wall 50, a top wall 52, a bottom wall 54, and at least two side walls 56, 58 extending between the top and bottom walls 52, 54, defining a cavity 60 therein. The cavity 60 has an opening 62 at a front end 12 of the housing 48, so that the cavity 60 is substantially viewable from the front by the observer. The simulated interior wall 26 is preferably proximal to the back wall 50. Preferably, the simulated fuel bed 14 is disposed in the cavity 60 proximal to the opening 62. As shown in FIG. 3A, the screen 18 is positioned behind the simulated fuel bed 14 and in front of the interior wall 26.

As can be seen in FIGS. 1, 2A and 3A, the flame simulating assembly 10 preferably also includes two simulated interior fireplace sidewalls 38, 40. Each of the simulated interior fireplace sidewalls 38, 40 extends from the simulated interior wall 26 forwardly beyond the front surface 20 of the screen 18.

In the preferred embodiment, the interior element 26 has a pattern 36 simulating firebrick in the firebox of a real fireplace thereon. Preferably, the simulated interior fireplace sidewalls 38, 40 also have patterns 42 simulating firebrick thereon. In the preferred embodiment, the patterns 42 on the simulated interior fireplace sidewalls 38, 40 are positioned to be aligned with the pattern 36 on the interior element 26.

Although the pattern 36 and the patterns 42 are simulated firebrick (FIGS. 1 and 2A), various patterns could be used on the interior element 26 and the interior sidewalls 38, 40. As will be appreciated by those skilled in the art, various patterns could be used to achieve different simulating effects.

In use, the flicker element 44 causes light from the light source 16 to fluctuate upon reflection thereof by the flicker element 44. In the preferred embodiment, light from the light source 16 reflected by the flicker element 44 and thereby caused to fluctuate, or flicker, is configured by the flame effect element 46 to form one or more images of flames 11 transmitted through the screen 18. The images of flames 11 appear to be rising from the simulated fuel bed 14, and the observer also can simultaneously observe the simulated interior fireplace wall 26. The transition region 32 provides a relatively gradual transition between the viewing region 28 and the observation region 30, to enhance the simulation effect.

Figure 10:
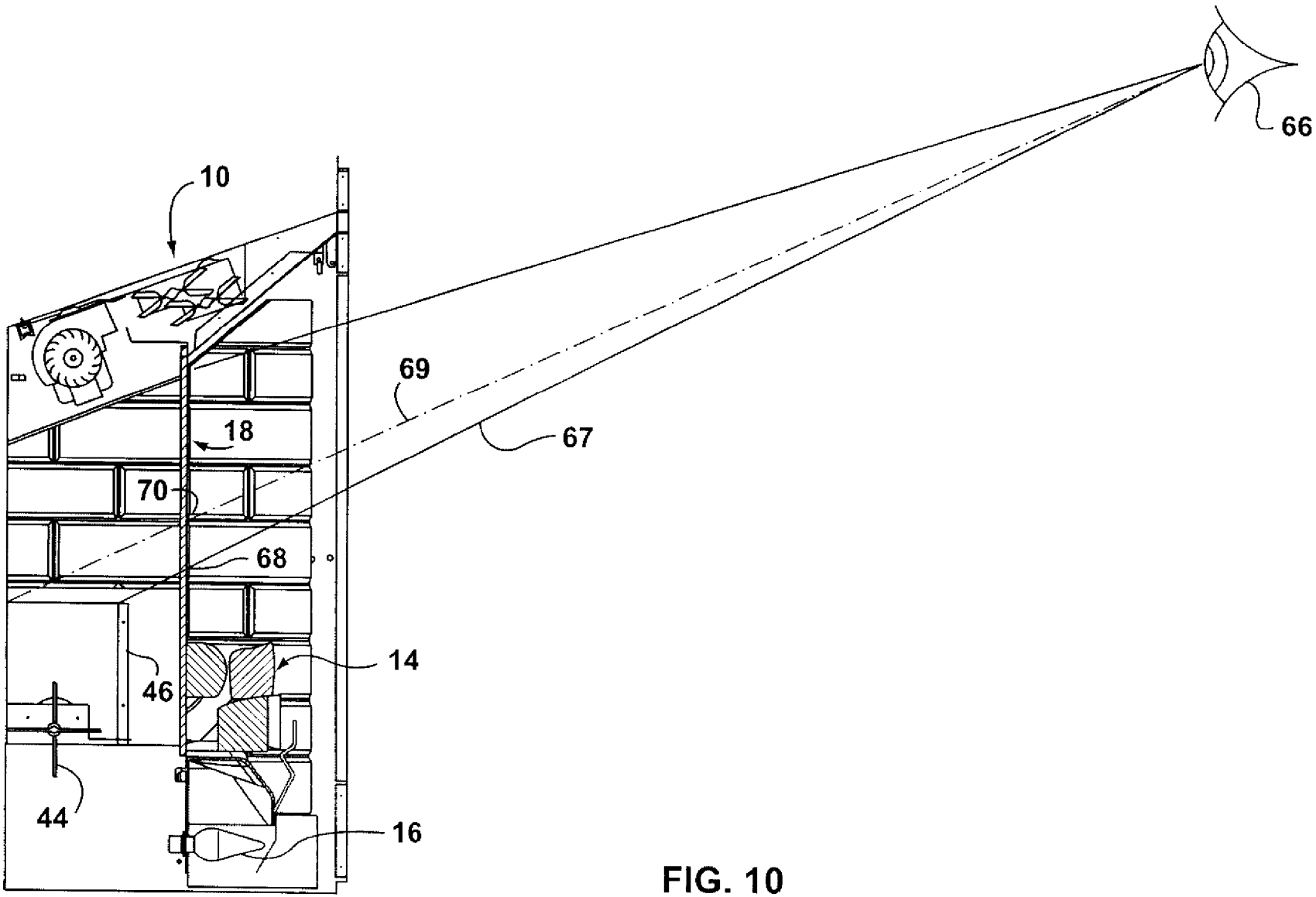
FIG. 10 is a cross section of the flame simulating assembly of FIG. 3A, drawn at a smaller scale.

Referring to FIG. 10, an eye 66 of an observer (not shown) is typically positioned so that a lower extent of the observer's field of vision (schematically represented by a line 67) intersects the screen 18 at 68. In FIG. 10, the lower edge 29 of the transition region 32 (i.e., the upper edge 29 of the viewing region 28) (FIG. 2B) is preferably located substantially at 68 on the front surface 20 of the screen 18. Similarly, an approximate middle of the observer's field of vision (schematically represented by a line 69) intersects the screen 18 at 70. In the preferred embodiment, the lower edge 31 of the observation region 30 (i.e., the upper edge 31 of the transition region 32) (FIG. 2B) is preferably located at 70 on the front surface 20 of the screen 18. The positioning of the edges 29, 31 of the regions 28, 30, 32 on the front surface 20 can be varied to suit the relative positioning of the screen 18 and the internal components in a flame simulating assembly 10, and in accordance with an assumed relative positioning (or range of positions) of the observer.

If preferred, the flame simulating assembly 10 optionally includes a shield 64, for obstructing light from the light source 16 which is directed to the vicinity of the observation region 30 or for concealing certain components. The shield 64 is preferably positioned behind the screen 18 and below the transition region 32 and beside or below the transition region 32. As can be seen in FIG. 10, an observer's eye 66 observing the flame simulating assembly 10 is typically positioned so that the observer cannot observe the flame effect element 46 or other components positioned behind the screen 18 directly. However, it is possible that an observer (not shown) could be positioned so as to view some of the internal components (such as the flicker element 44, or the flame effect element 46) directly, or light from the light source 16 directed to the observation region 30 may distract the observer. In either or both of these circumstances, it may be advantageous to include the shield 64 in the flame simulating assembly 10. A preferred embodiment of the shield 64 is shown in FIG. 3A.

However, it has been found that, if the components are positioned appropriately relative to each other and relative to the observation region 30 and the transition region 32, the shield 64 is generally not necessary. As can be seen in FIG. 10, the positioning of the flame effect element 46 and the flicker element 44 relative to the transition region 32 and the observation region 30 can affect the effectiveness of the simulation provided by the flame simulating assembly 10. The flame effect element 46 and the flicker element 44 are preferably not positioned where the ordinarily located observer would be able to observe these components directly through the transition region 32 or the observation region 30.

Additional embodiments of the invention are shown in FIGS. 3B, 4, 5, 6A, 6B, 7-9 and 11-25. In FIGS. 3B, 4, 5, 6A, 6B, 7-9 and 11-25, elements are numbered so as to correspond to like elements shown in FIGS. 1, 2A, 2B, and 3A.

Figure 4:
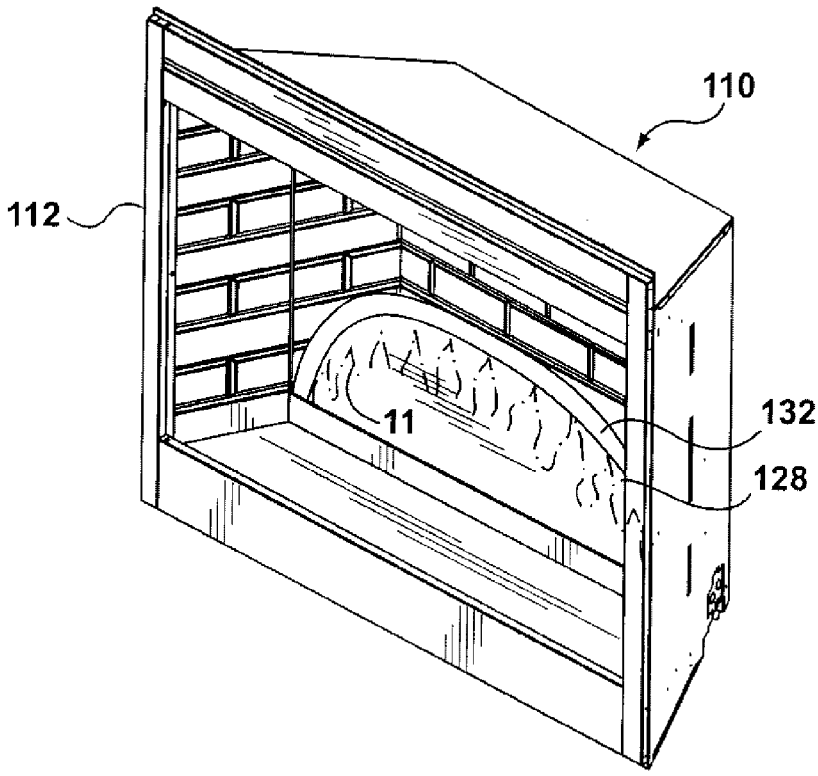
FIG. 4 is an isometric view of another embodiment of the flame simulating assembly of the invention, drawn at a smaller scale.
Figure 5:
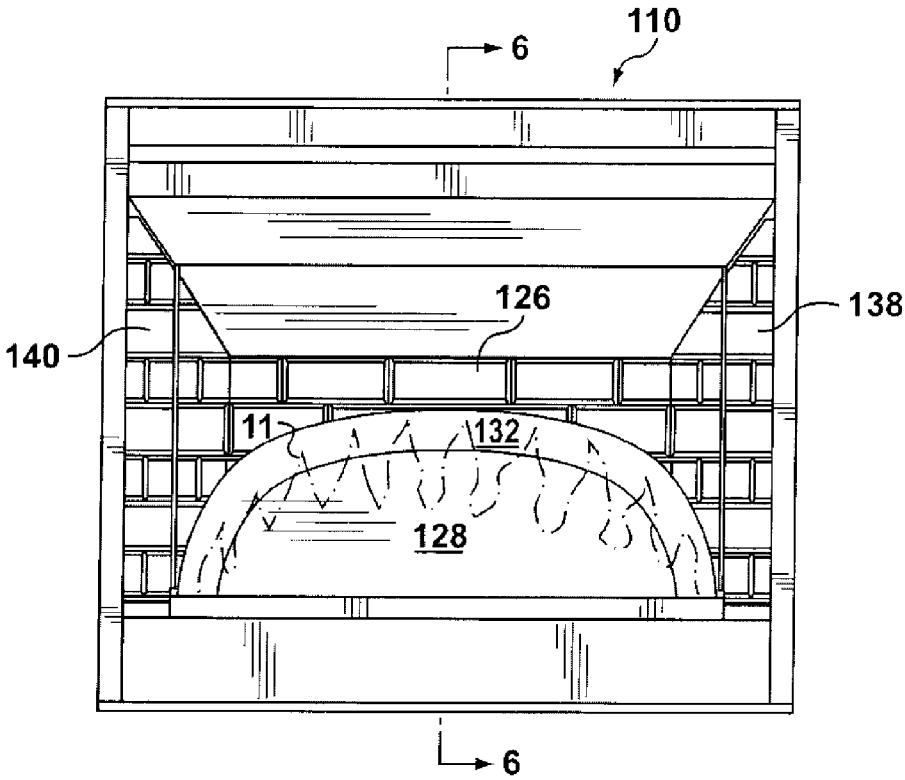
FIG. 5 is a front view of the flame simulating assembly of FIG. 4.
Figure 6A:
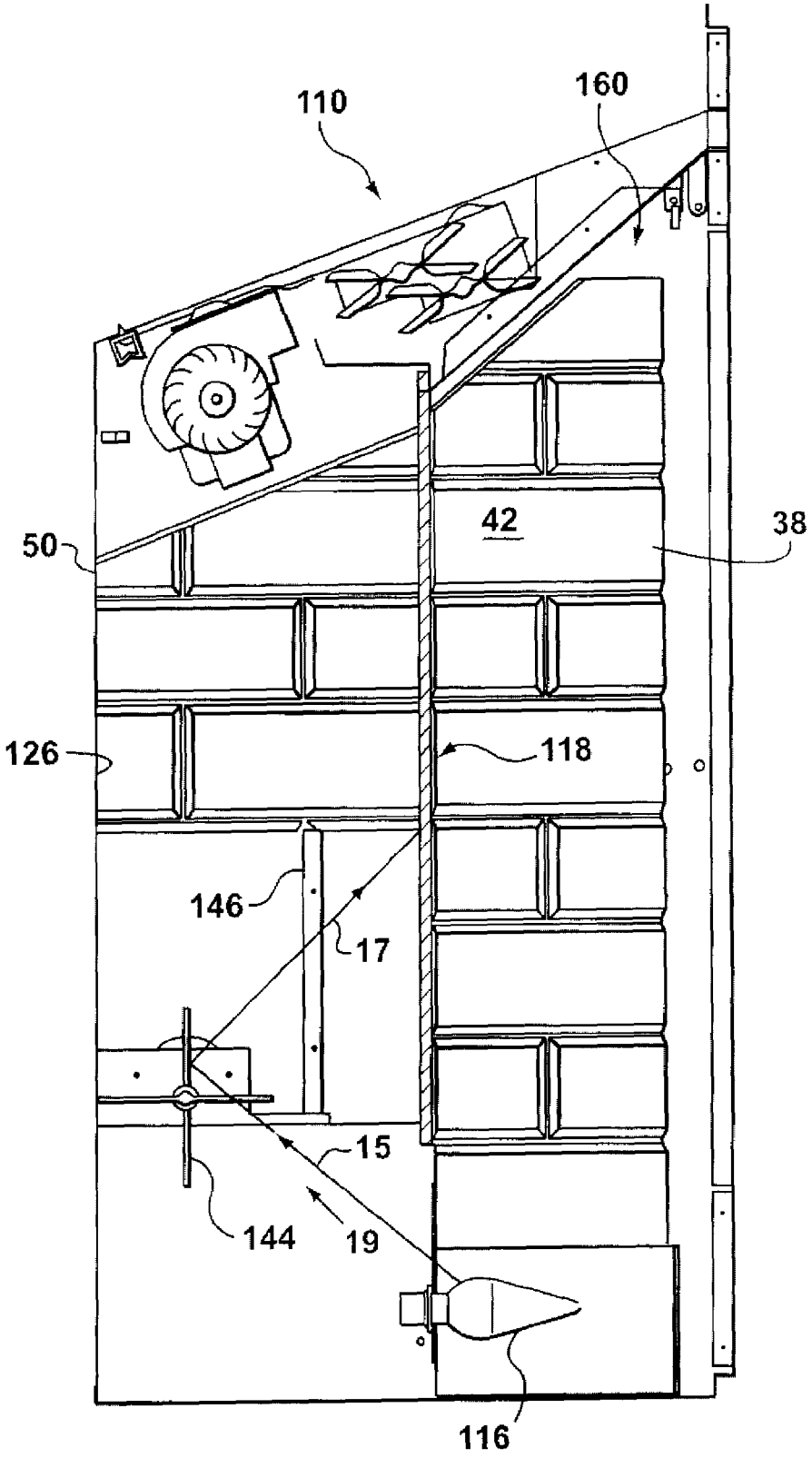
FIG. 6A is a cross section of the flame simulating assembly of FIG. 4 taken along line 6-6 in FIG. 5, drawn at a larger scale.

An alternative embodiment 110 of the flame simulating assembly is shown in FIGS. 4, 5 and 6A. The flame simulating assembly 110 does not include a simulated fuel bed, but is adapted for use with a simulated fuel bed (not shown) which is to be provided separately by a user (not shown). The simulated fuel bed, when provided, is to be located proximate to a front side 112 of the flame simulating assembly 110. The flame simulating assembly 110 includes a cavity 160, and also has a light source 116 for providing an image of flames 11 and the screen 18 positioned in the cavity 160. The flame simulating assembly 110 also includes the simulated interior fireplace wall 26 positioned behind the screen 18. The screen 18 includes the front surface 20 with the viewing region 28, the observation region 30, and the transition region 32 positioned between the viewing region 28 and the observation region 30. The viewing region 28 is positioned, at least in part, at the bottom of the screen 18—i.e., adjacent to the simulated fuel bed, once provided. The observation region 30 is positioned distal to the viewing region 28.

Because it does not include a simulated fuel bed, the flame simulating assembly 110 requires relatively less materials, and would be relatively less costly to construct. The user could use any materials chosen by the user as a simulated fuel bed. For example, real wooden logs (with or without a grate) could be used.

Although the flame simulating assembly 110 is adapted for use with a separate simulated fuel bed, the flame simulating assembly 110 also could be used without a simulated fuel bed, if the user so chose.

In the flame simulating assembly 110, the simulated interior fireplace wall 26 is preferably mounted on or positioned adjacent to the back wall 50. Also, the flame simulating assembly 110 preferably includes two simulated interior fireplace sidewalls 38, 40. Each of the simulated interior fireplace sidewalls 38, 40 extends from the simulated interior fireplace wall 26 forwardly beyond the front surface 20 of the screen 18. The simulated interior fireplace wall 26 preferably includes the pattern 36 simulating firebrick thereon. Preferably, the simulated interior fireplace sidewalls 38, 40 also have patterns 42 simulating firebrick thereon. It is preferred that the patterns 42 on the simulated interior fireplace sidewalls 38, 40 are positioned to be aligned with the pattern 36 on the back wall 26.

Figure 3B:
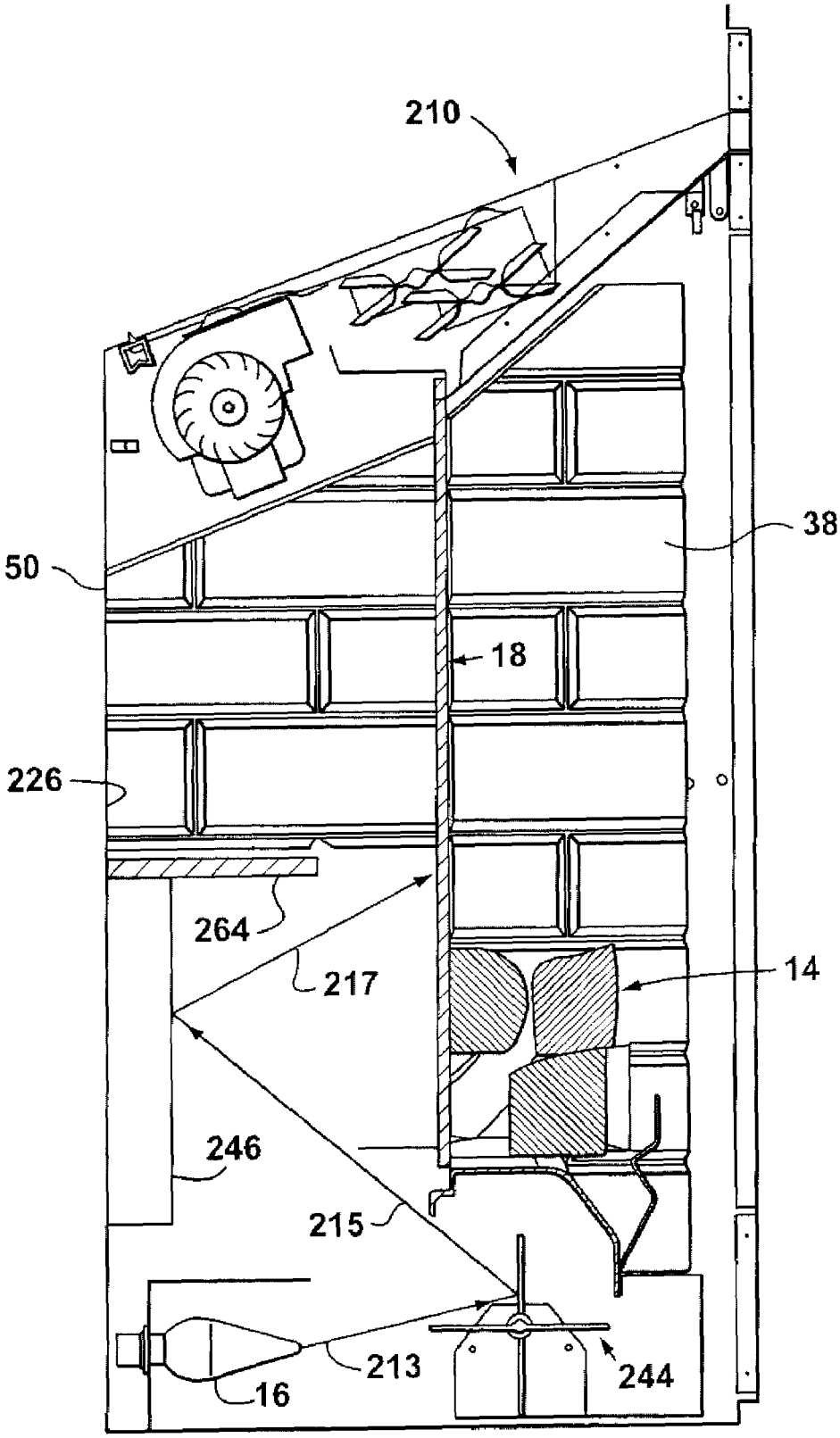
FIG. 3B is a cross section of an alternative embodiment of the flame simulating assembly of the invention.

In another alternative embodiment 210 of the flame simulating assembly of the invention, as can be seen in FIG. 3B, a flicker element 244 is positioned substantially underneath the simulated fuel bed 14. The flame simulating assembly 210 includes the housing 48, and a flame effect element 246 is mounted on or positioned proximal to the back wall 50. The flame effect element 246 is substantially reflective, and is preferably formed in the shape of flames. Preferably, the flame effect element 246 is similar to a flame effect element disclosed in U.S. Pat. No. 6,564,485. U.S. Pat. No. 6,564,485 is hereby incorporated herein by reference. Also, however, a simulated interior fireplace wall 226 is mounted proximal to the back wall 50, and in the vicinity of the flame effect element 246.

The flicker element 244 is positioned in a path of light 219 between the light source 16 and the screen 18. Similarly, the flame effect element 246 is positioned in the path of light 219 between the light source 16 and the screen 18. The path of light 219 is schematically represented by arrows 213, 215, and 217 (FIG. 3B).

The screen 18 in the flame simulating assembly 210 includes the viewing region 28, the observation region 30, and the transition region 32. The flicker element 244 causes light from the light source 16 to fluctuate upon reflection thereof by the flicker element 44. Light from the light source 16 which is reflected by the flicker element 44 and thereby caused to fluctuate, or flicker, is configured by the flame effect element 246 to form one or more images of flames 11 transmitted through the screen 18. The images of flames 11 appear to be rising from the simulated fuel bed 14, and the observer also can simultaneously observe the simulated interior fireplace wall 226. The transition region 32 provides a relatively gradual transition between the viewing region 28 and the observation region 30, to enhance the simulation effect. The positioning of the flicker element 244 substantially underneath the simulated fuel bed 14, and the positioning of the at least partially reflective flame effect element 246 proximal to, or on the back wall 50, results in an enhanced simulation effect.

Figure 11:
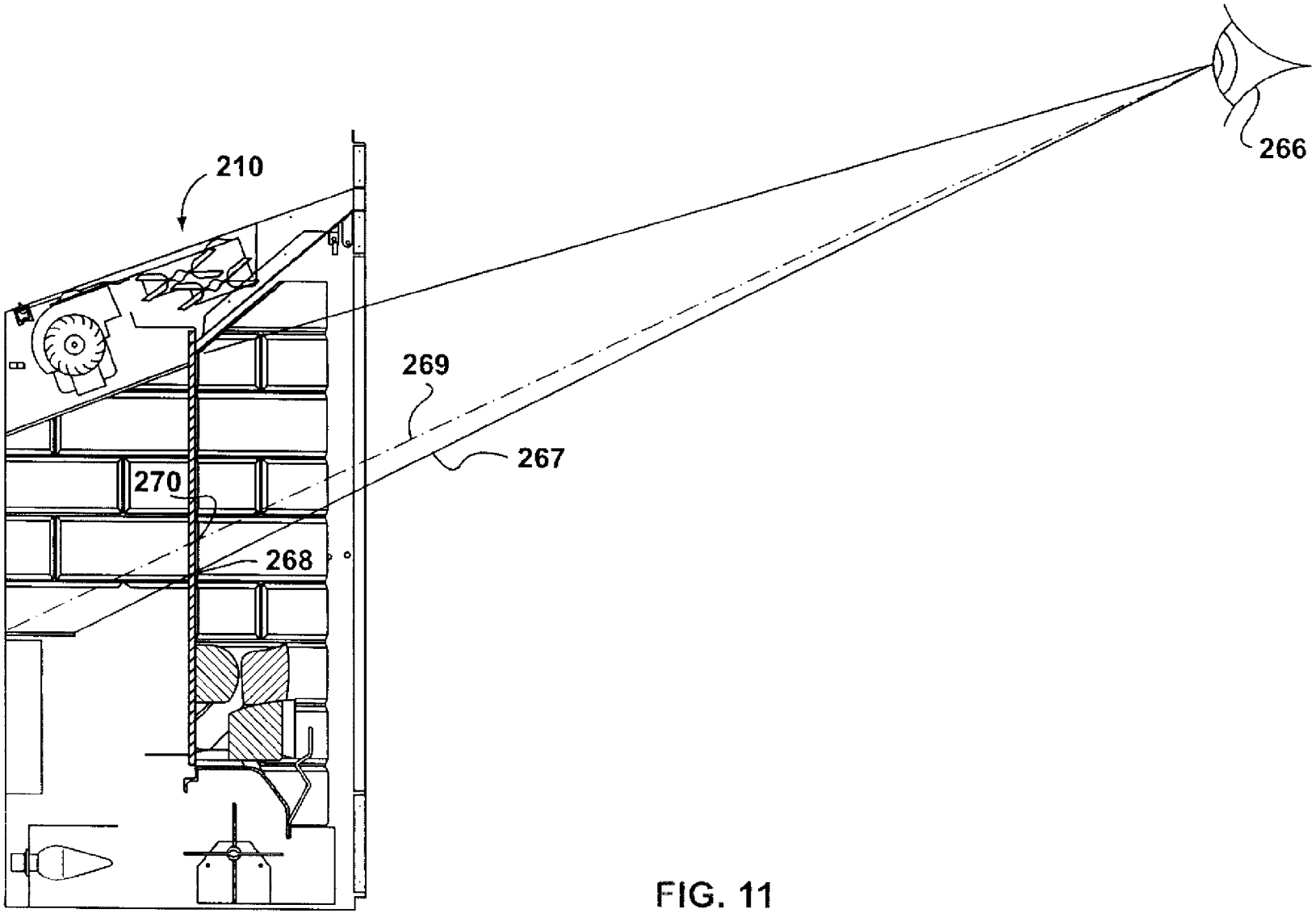
FIG. 11 is a cross section of the flame simulating assembly of FIG. 3B.

Referring to FIG. 11, an eye 266 of an observer (not shown) is typically positioned so that a lower extent of the observer's field of vision (schematically represented by a line 267) intersects the screen 18 at 268. In FIG. 11, the lower edge 29 of the transition region 32 (i.e., the upper edge 29 of the viewing region 28) (FIG. 2B) is preferably located substantially at 68 on the front surface 20 of the screen 18. Similarly, an approximate middle of the observer's field of vision (schematically represented by a line 269) intersects the screen 18 at 270. In the preferred embodiment, the lower edge 31 of the observation region 30 (i.e., the upper edge 31 of the transition region 32) (FIG. 2B) is preferably located on the front surface 20 of the screen 18. The positioning of the edges 29, 31 of the regions 28, 30, 32 on the front surface 20 can be varied to suit the relative positioning of the screen 18 and the internal components in a flame simulating assembly 210, and in accordance with an assumed relative positioning (or range of positions) of the observer.

If preferred, the flame simulating assembly 210 optionally includes a shield 264, for obstructing light from the light source 16 which is directed to the vicinity of the observation region 30 or for concealing certain components. The shield 264 is preferably positioned behind the screen 18 and beside or below the transition region 32. As can be seen in FIG. 11, an observer's eye 266 observing the flame simulating assembly 210 is typically positioned so that the observer cannot observe the flame effect element 246 or other components positioned behind the screen 18 directly. However, it is possible that an observer (not shown) could be positioned so as to view some of the internal components (such as the flicker element 244, or the flame effect element 246) directly, or light from the light source 16 directed to the observation region 30 may distract the observer. In either or both of these circumstances, it may be advantageous to include the shield 264 in the flame simulating assembly 210. A preferred embodiment of the shield 264 is shown in FIG. 3B.

However, it has been found that, if the components are positioned appropriately relative to each other and relative to the observation region 30 and the transition region 32, the shield 264 is generally not necessary. As can be seen in FIG. 11, the positioning of the flame effect element 246 and the flicker element 244 relative to the transition region 32 and the observation region 30 can affect the effectiveness of the simulation provided by the flame simulating assembly 210. The flame effect element 246 and the flicker element 244 are preferably not positioned where the ordinarily located observer would be able to observe these components directly through the transition region 32 or the observation region 30.

Figure 6B:
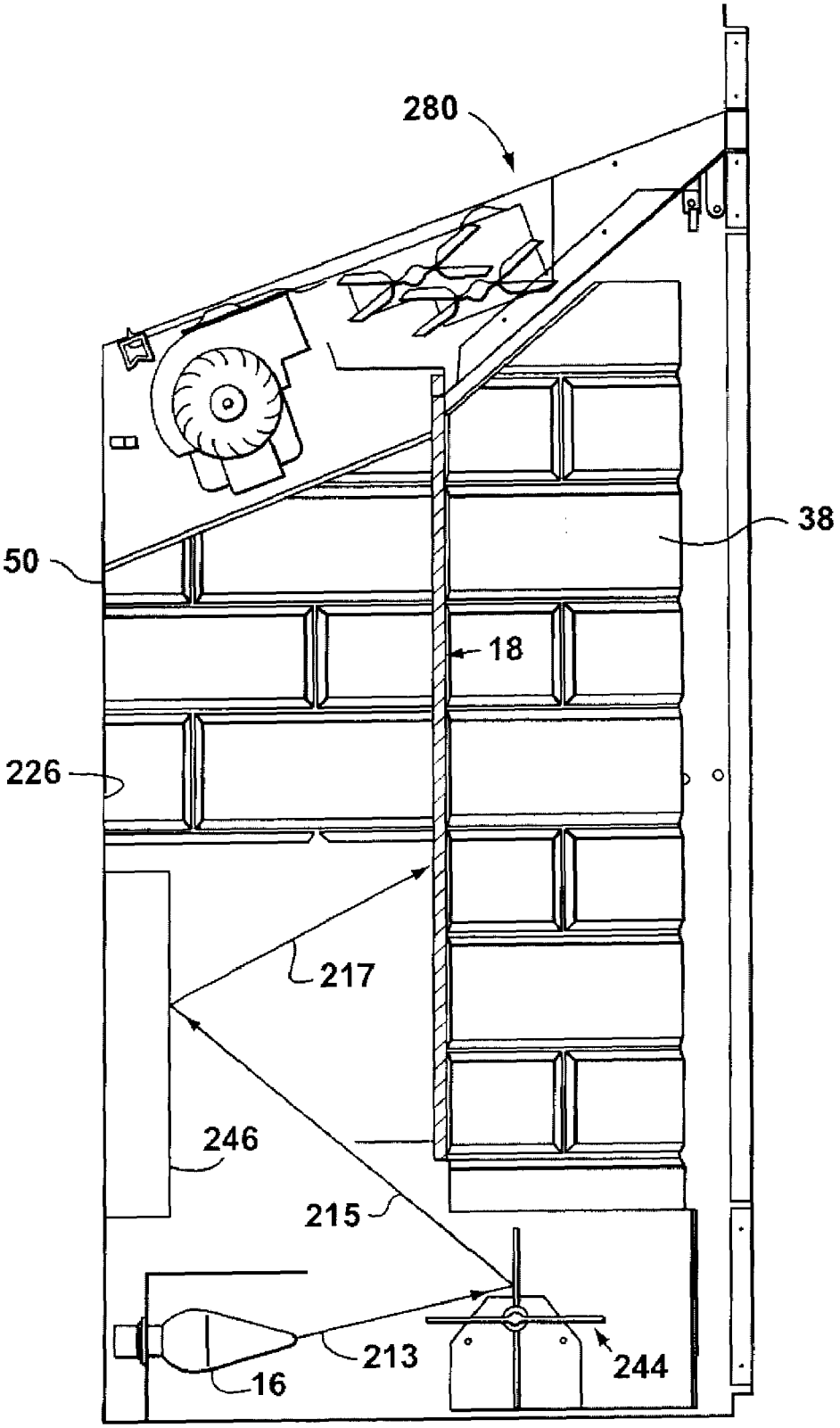
FIG. 6B is a cross section of another alternative embodiment of the flame simulating assembly of the invention.

In FIG. 6B, another alternative embodiment 280 of a flame simulating assembly of the invention is shown. The flame simulating assembly 280 is the same as the flame simulating assembly 210 shown in FIG. 3B, except that flame simulating assembly 280 does not include a simulated fuel bed. As in flame simulating assembly 110, the user can provide a simulated fuel bed or, if preferred, operate the unit without a simulated fuel bed. The flame simulating assembly 280 also is not shown as including the optional shield element.

Figure 12:
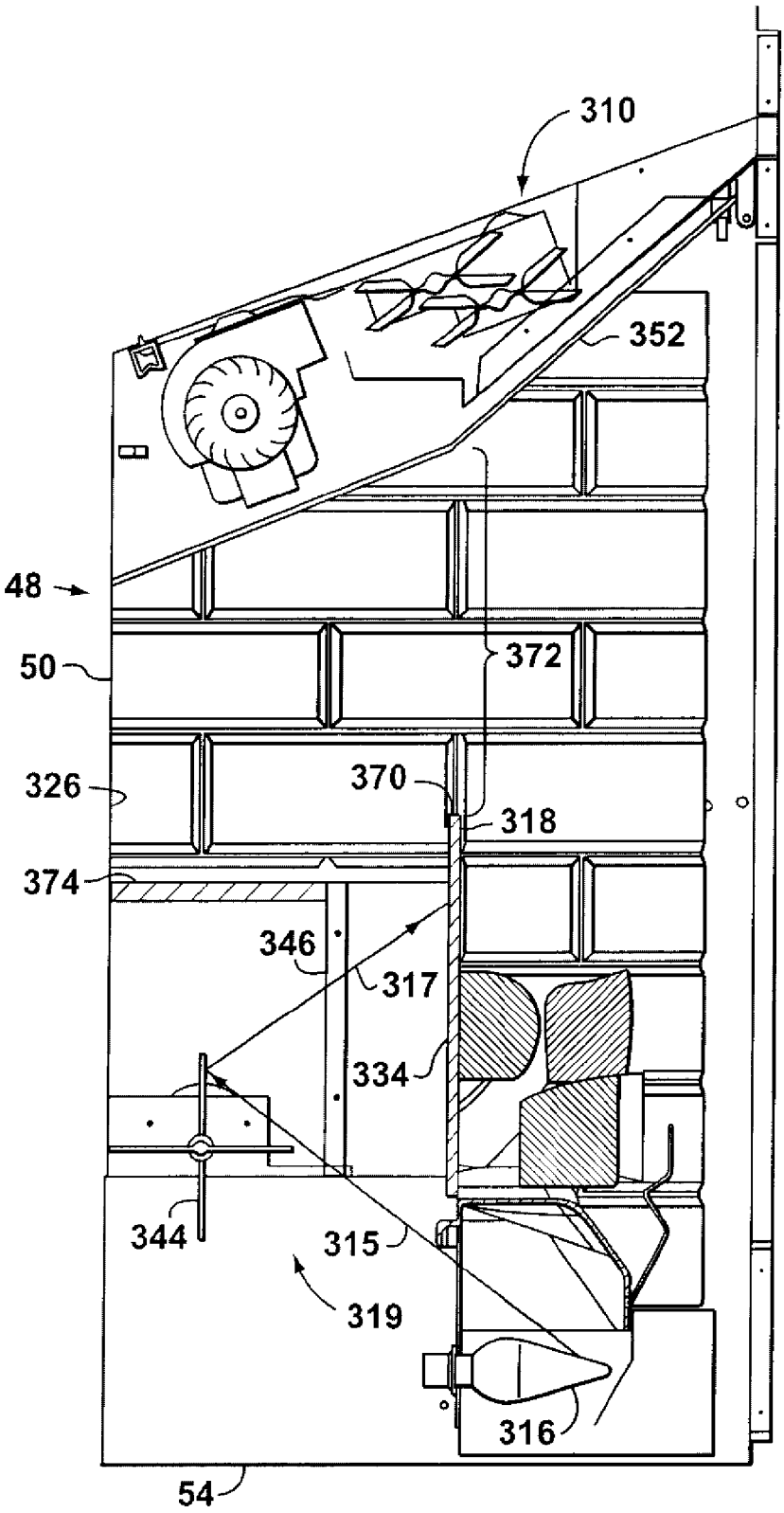
FIG. 12 is a cross section of an alternative embodiment of the flame simulating assembly including an alternative embodiment of the screen, drawn at a larger scale.
Figure 13:
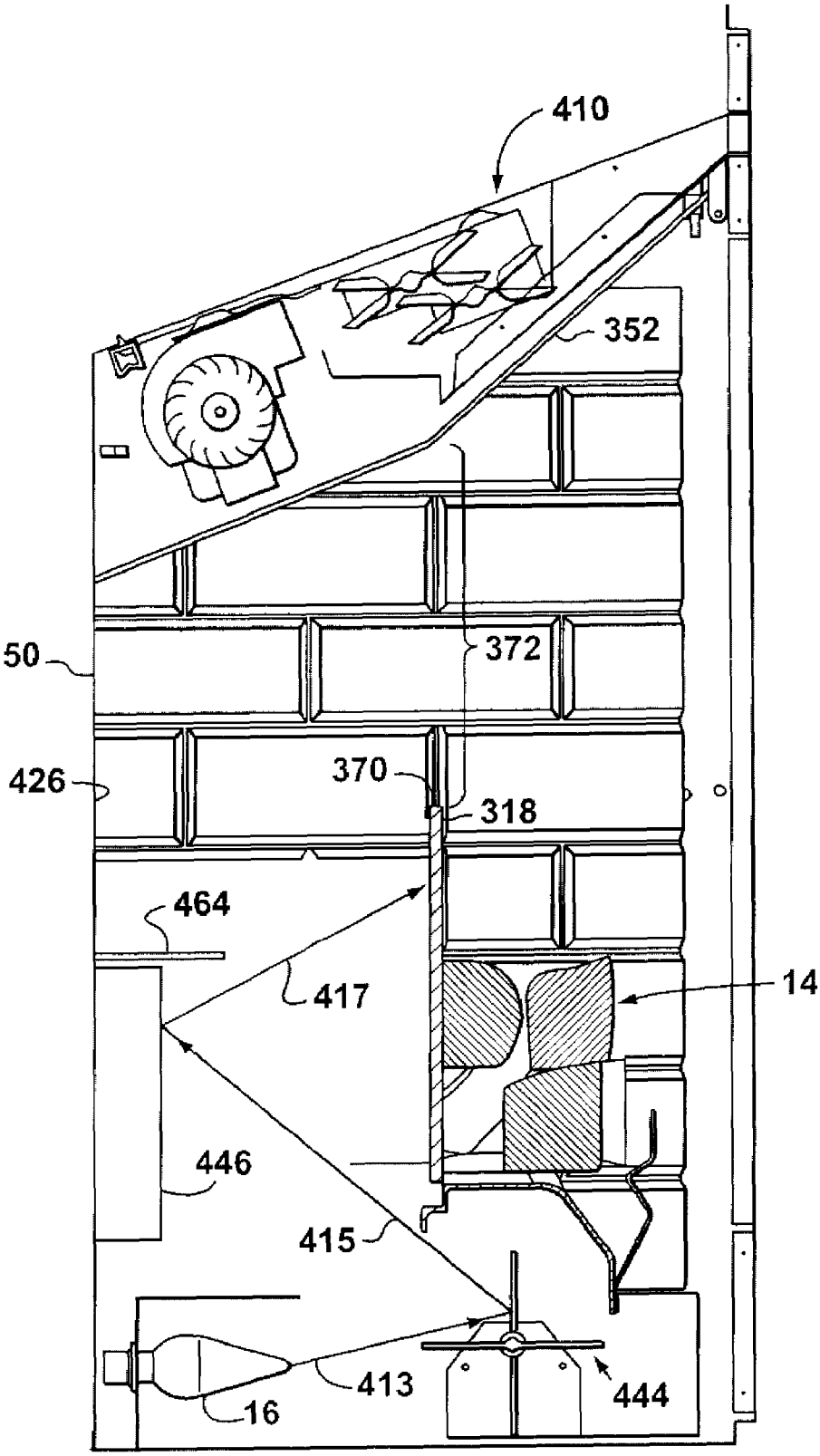
FIG. 13 is a cross section of another alternative embodiment of the flame simulating assembly including the alternative embodiment of the screen in the flame simulating assembly of FIG. 12.
Figure 14:
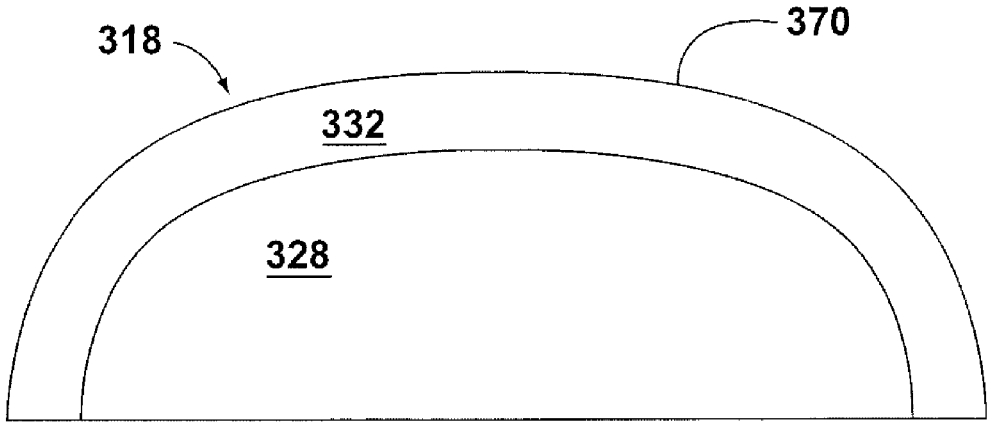
FIG. 14 is a front view of the alternative embodiment of the screen of FIGS. 12 and 13, drawn at a larger scale.

An alternative embodiment 318 of a screen is shown in FIGS. 12-14. As can be seen in FIG. 12, the screen 318 is included in an alternative embodiment of a flame simulating assembly 310. The flame simulating assembly 330 includes the housing 48, which includes the back wall 50, a top wall 352, a bottom wall 54, and at least two side walls 56, 58 extending between the top and bottom walls 352, 54. The flame simulating assembly 310 also includes a simulated interior fireplace wall 326 mounted on or positioned proximal to the back wall 50. The screen 318 is positioned behind the simulated fuel bed 14 and in front of the simulated interior fireplace wall 326.

As can be seen in FIG. 12, the flame simulating assembly 310 also includes a light source 316, a flicker element 344 positioned in a path of light 319 (schematically represented by arrows 315, 317), and a flame effect element 346, also positioned in the path of light 319. The flame effect element 346 is for configuring light from the light source 316 into one or more images of flames 11 which are transmitted through the screen 318. The flicker element 344 is for causing light from the light source to flicker or fluctuate, thereby enhancing the overall simulation effect.

As can be seen in FIGS. 12 and 14, the screen 318 extends upwardly to a top edge 370, located distal to the simulated fuel bed 14. The top edge 370 is spaced apart from the top wall 352 to form an upper opening 372 between the top wall 352 and the screen 318. Substantially unobstructed observation is thus permitted through the upper opening 372, so that the simulated interior fireplace wall 326 is observable. Because this is similar to the substantially unobstructed observation of a firebox which may be enjoyed by an observer of a real fireplace (i.e., one in which wood or coal may be burned), the upper opening 372 tends to enhance the overall simulation effect.

Optionally, a shield 374 (shown in FIG. 12) may be included in the flame simulating assembly 310. The shield 374 (similar to the shield 64, shown in FIG. 3A) is for obstructing light from the light source 16 which may be directed above the top edge 370 of the screen 318 or for concealing certain components. The shield 374 is preferably positioned behind the screen 318 and beside or below the transition region 332. It is possible that the observer could be positioned so as to view some of the internal components (such as the flicker element 344, or the flame effect element 346) directly, or light from the light source 16 directed above the top edge 370 of the screen 318 may distract the observer. In either or both of these circumstances, it may be advantageous to include the shield 374 in the flame simulating assembly 310. A preferred embodiment of the shield 374 is shown in FIG. 12.

However, it has been found that, if the internal components are positioned appropriately relative to each other and relative to the transition region 332 and the top edge 370, the shield 374 is generally not necessary. The flame effect element 346 and the flicker element 344 are preferably not positioned where the ordinarily located observer would be able to observe these components directly through the transition region 332 or the upper opening 372.

Preferably, the screen 318 includes a viewing region 328 and a transition region 332. In the preferred embodiment, the viewing region 328 is partially reflective, although the images of flames 11 are also transmittable through the viewing region 328. Also, the screen 318 preferably includes a transition region 332 extending from the viewing region 328 to the top edge 370. The transition region 332 is preferably lightly silvered (and therefore also partially reflective), so that the simulated interior fireplace wall 326 is at least partially viewable through the transition region 332. A back surface 334 of the screen 318 diffuses light from the light source 16, also to enhance the overall simulation effect. Also, however, the images of flames 11 are partially observable through the transition region 332.

Alternatively, the viewing region 332 is translucent. For example, the screen 318 could be suitably tinted glass or plastic (or other suitable material) through which the image of flames 11 is transmittable. The transition region 332 also could be suitably tinted, to enhance the overall simulation effect.

Another alternative embodiment of a flame simulating assembly 410 of the invention, shown in FIG. 13, includes the screen 318. In the flame simulating assembly 410, a flicker element 444 is positioned substantially underneath the simulated fuel bed 14. The flame simulating assembly 410 includes the housing 48, and a flame effect element 446 is mounted on or positioned proximal to the back wall 50. The flame effect element 446 is preferably reflective (or substantially reflective), and is preferably formed in the shape of flames. Preferably, the flame effect element 446 is similar to a flame effect element disclosed in U.S. Pat. No. 6,564,485. Also, however, a simulated interior fireplace wall 426 is mounted proximal to the back wall 50, and in the vicinity of the flame effect element 446.

The flicker element 444 is positioned in a path of light 419 between the light source 16 and the screen 318. Also, the flame effect element 446 is positioned in the path of light 419 between the light source 16 and the screen 318. The path of light 419 is schematically represented by arrows 413, 415, and 417 (FIG. 13).

The positioning of the flicker element 444 substantially underneath the simulated fuel bed 14, and the positioning of the flame effect element 446 proximal to or on the back wall 50, results in an enhanced simulation effect. Preferably, the flame simulating assembly 410 includes a shield 464 for obstructing light from the light source directed above the screen 318.

Figure 7:
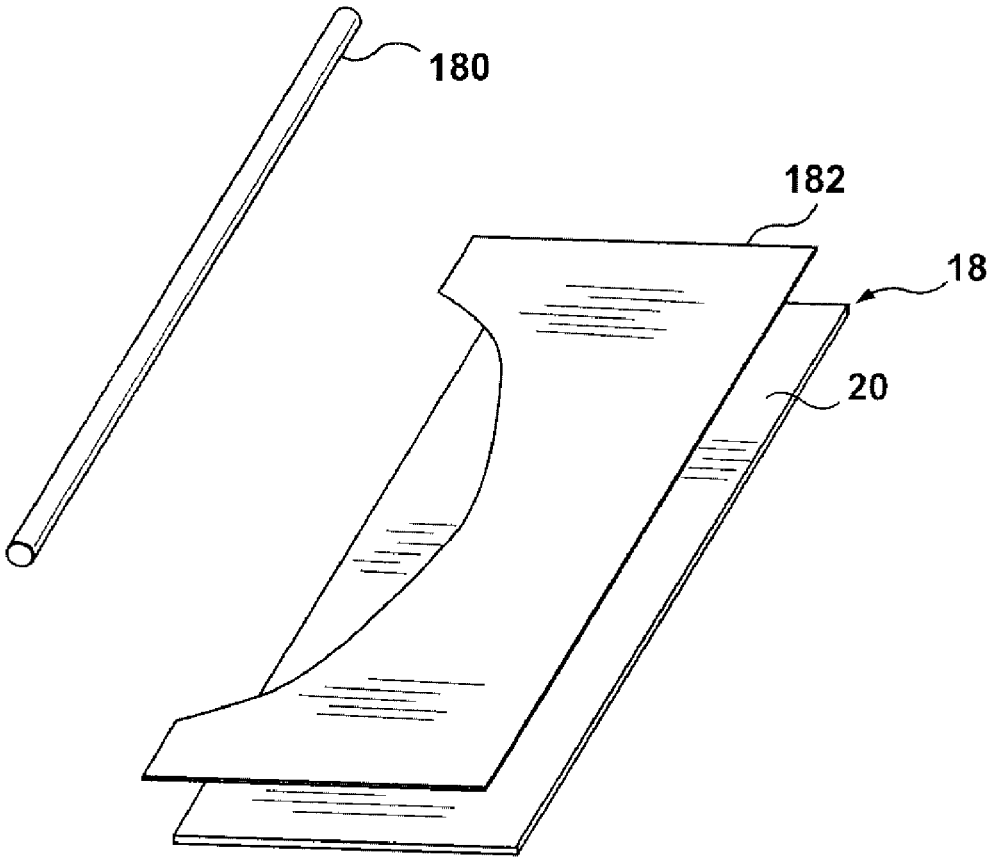
FIG. 7 is an isometric view of a screen having a front surface, with a mask element and a source of vaporized metal positioned relative to each other and to the front surface.
Figure 8:
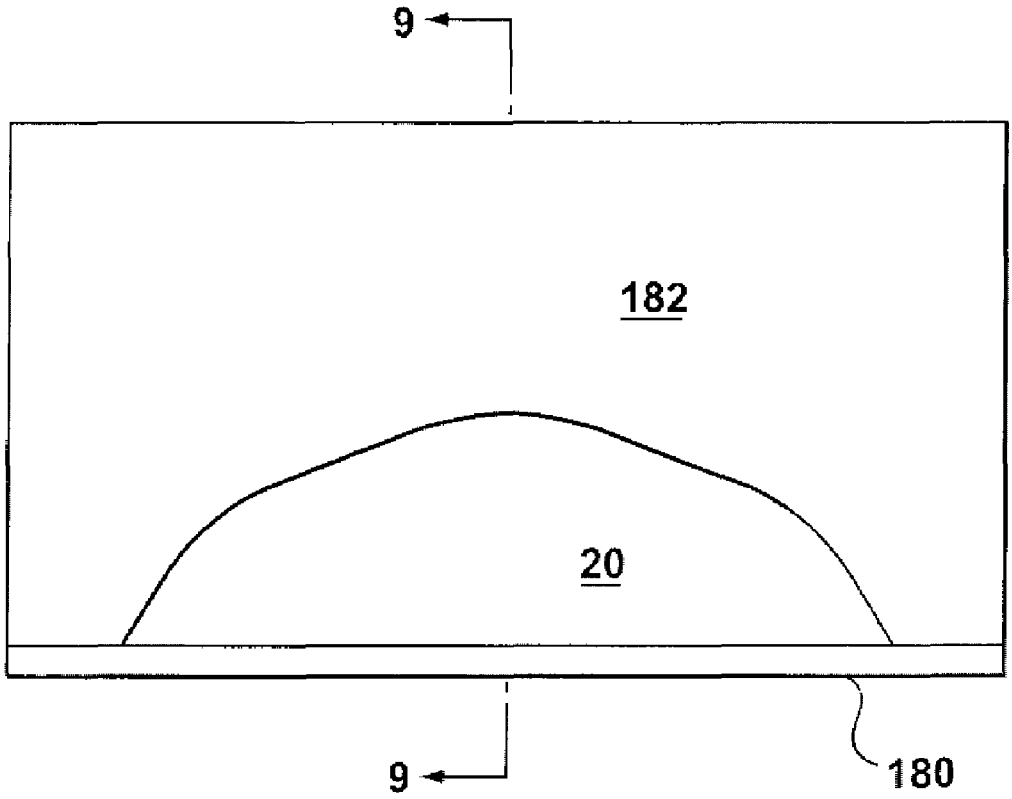
FIG. 8 is a front view of the screen, the mask element, and the source of FIG. 7, drawn at a larger scale.
Figure 9:
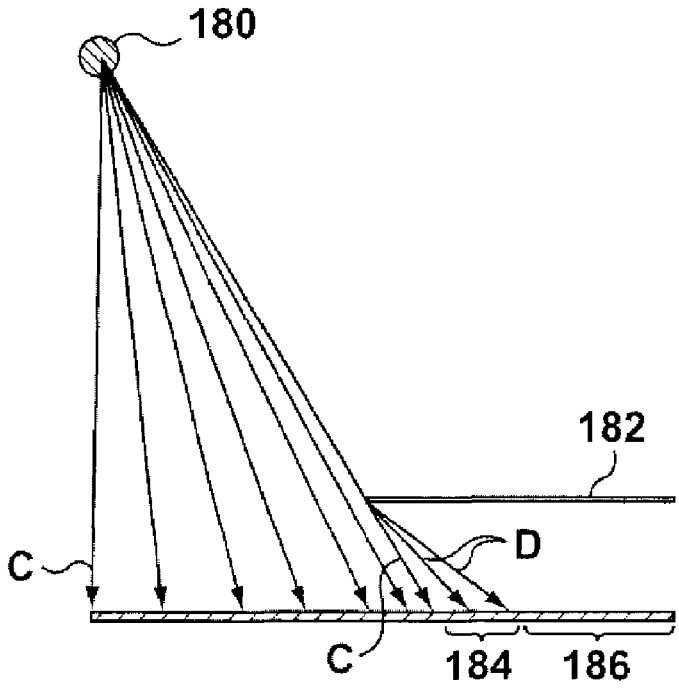
FIG. 9 is a cross section of the screen, the mask element, and the source of FIG. 8 taken along line 8-8 in FIG. 7.

The translucent portion 28 and the transition portion 32 on the front surface 12 of the screen 18 are preferably partially reflective, and are preferably created as follows. As shown in FIG. 7, a source 181 of vaporized metal (not shown) adapted for spraying vaporized metal onto the front surface 20 is provided. Also, a mask element 182 is provided, to substantially prevent vaporized metal sprayed from the source 181 from condensing on the transparent portion 32 of the front surface 20. The mask element 182 is positioned in a predetermined mask position relative to the source 181 and the front surface 20, as shown in FIGS. 7-9. The source 181 is also positioned in a predetermined source position relative to the mask element 182 and the front surface 20 so that vaporized metal is sprayable from the source 181 onto the translucent portion 28 and the transition portion 32 of the front surface 20.

The path of the vaporized metal sprayed from the source 181 onto the front surface 20 is schematically shown by arrows C and D in FIG. 9. The arrows identified as C in FIG. 9 represent metal vapor which is sprayed directly onto the front surface 20 to form the translucent portion 28. The arrows identified as D in FIG. 9 represent the metal vapor which is distributed over a portion of the front surface 20 to form the transition portion 32. As can be seen in FIG. 9, the transition portion 32 is in an area 184 on which vaporized metal condenses, spread out so that its concentration is not as great as in the translucent portion because the mask element 182 prevents spraying of the vaporized metal directly onto the area 184. As can be seen in FIG. 9, the mask element 182 also prevents vaporized metal from condensing in the transparent portion 30, formed in an area 186.

Preferably, the screen 18, 118 comprises glass. Alternatively, a suitable polycarbonate (such as plexiglas) or a suitable acrylic material can be used.

The vaporized metal is preferably produced by passing a relatively high electric current through a suitably prepared metal, such as aluminium. As is known in the art, the high current vaporizes the metal, i.e., changes the metal so that it is in a gaseous state. The vaporized metal can then be sprayed onto a surface which is at a lower temperature (e.g., the surface 20, at room temperature), causing the rapid "condensation" (i.e., solidification) of the vaporized metal on the cooler surface.

Alternatively, some or all of the viewing region 28 can be formed using silvered film, attached to the front surface by any suitable means. For example, where the viewing region includes silvered film, the transition region could be formed by spraying suitable materials onto the front surface. Alternatively, both the viewing region 28 and the transition region 32 could be formed using silvered film.

Figure 15:
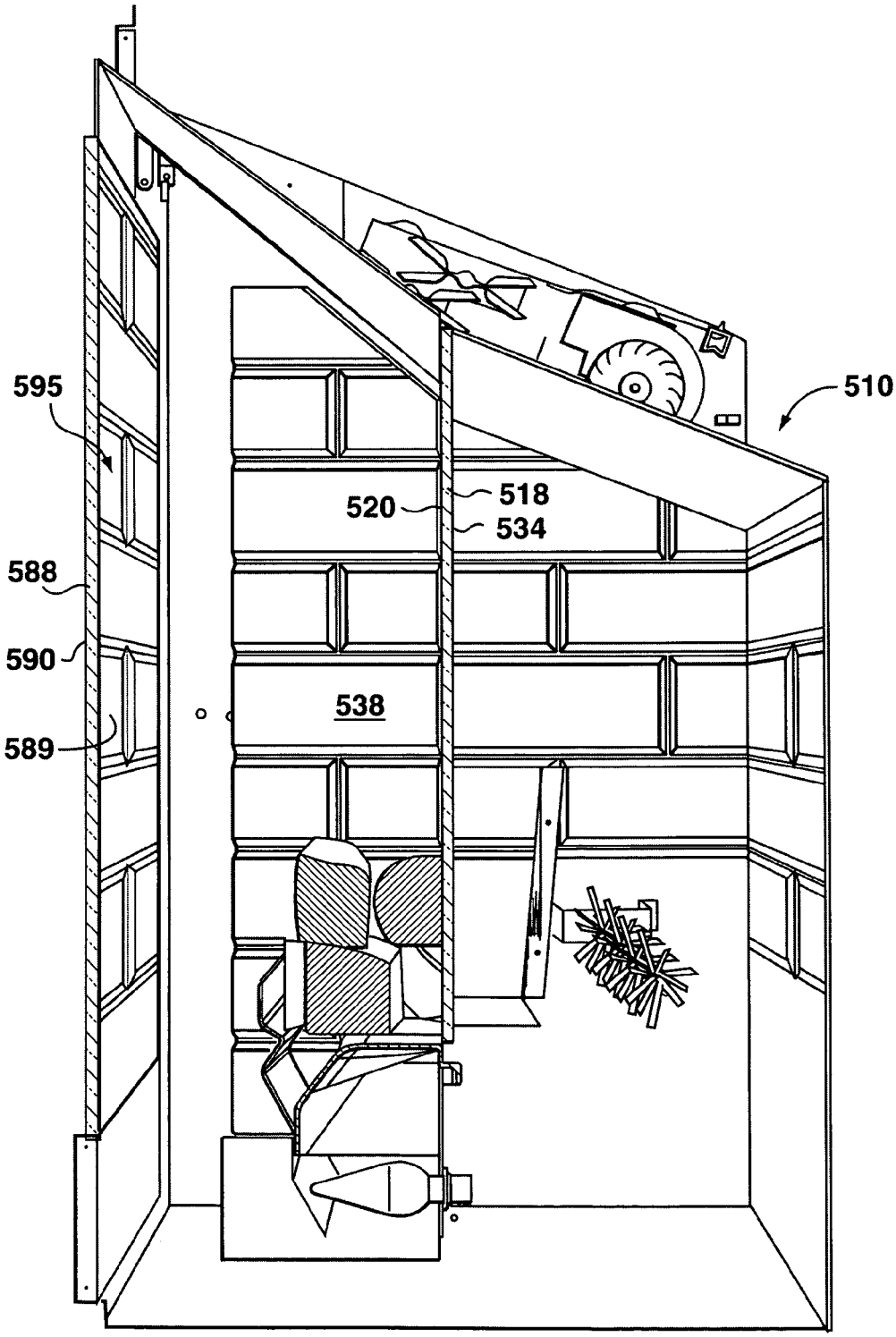
FIG. 15 is an isometric view of another embodiment of the flame simulating assembly of the invention.
Figure 16:
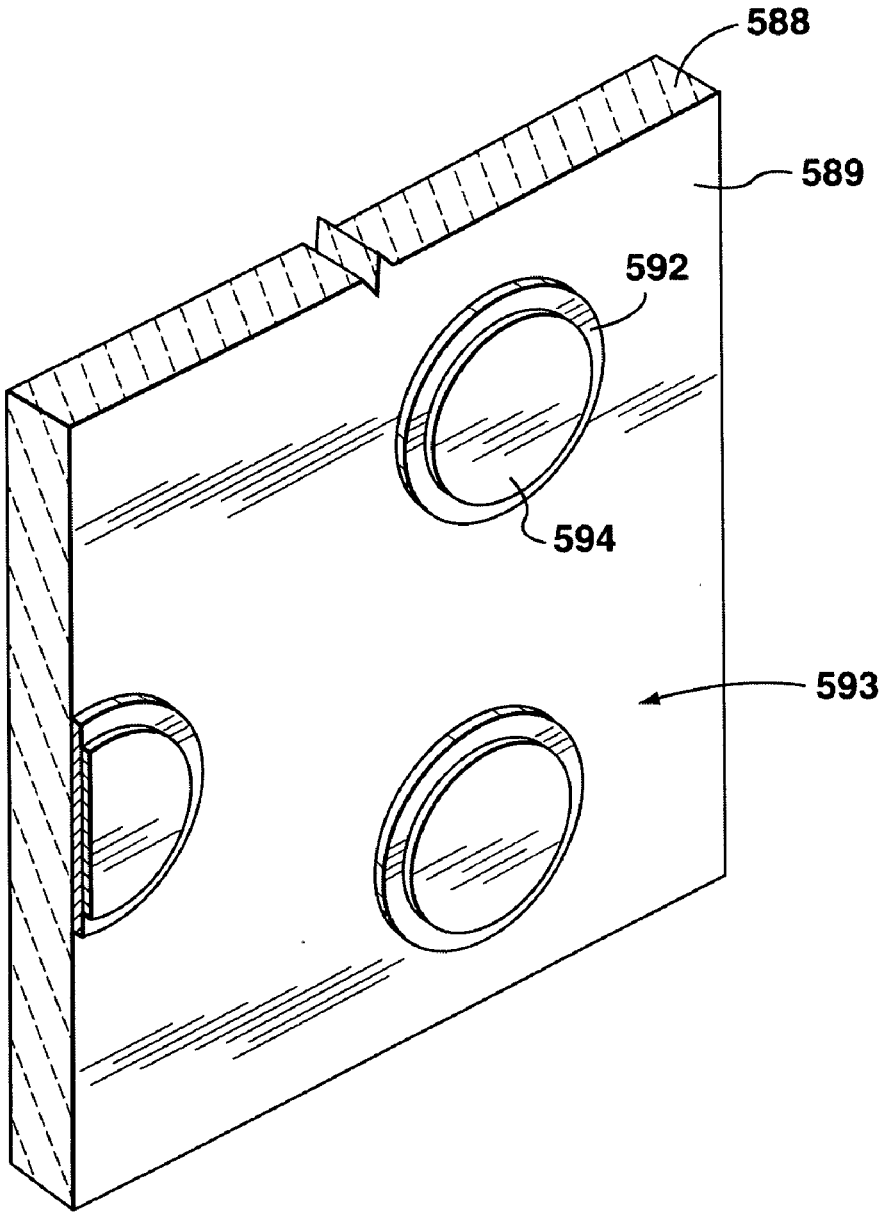
FIG. 16 is an enlarged isometric view of an inner surface of a front wall of the flame simulating assembly of FIG. 15.
Figure 17:
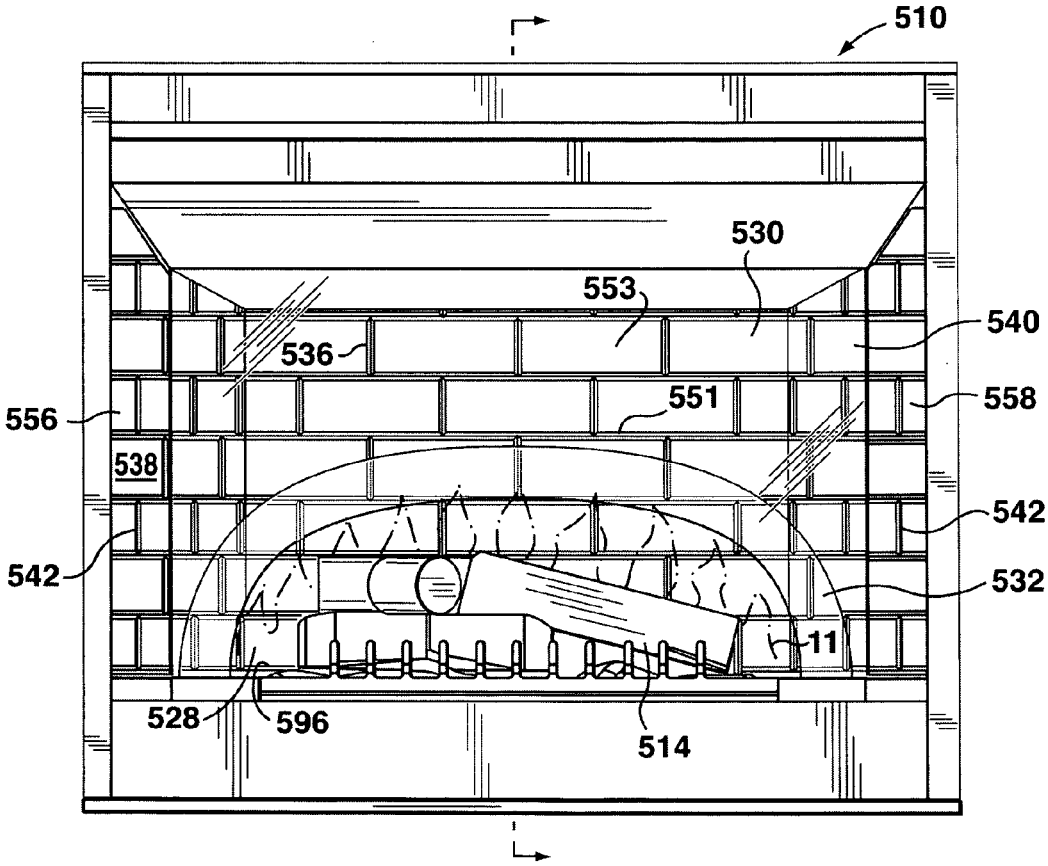
FIG. 17 is a front view of the flame simulating assembly of FIG. 15.
Figure 18:
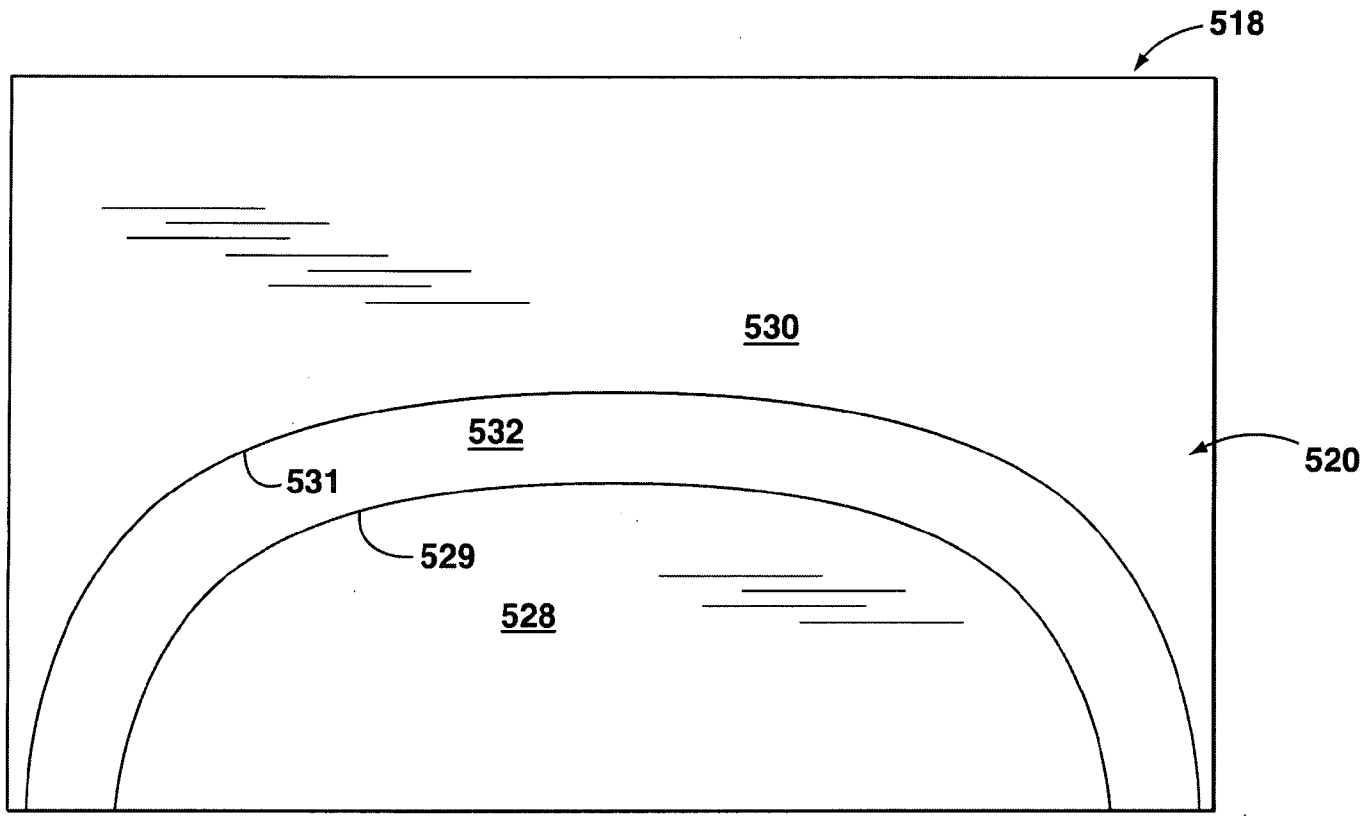
FIG. 18 is a front view of an embodiment of a screen included in the flame simulating assembly of FIG. 17, drawn at a larger scale.
Figure 19:
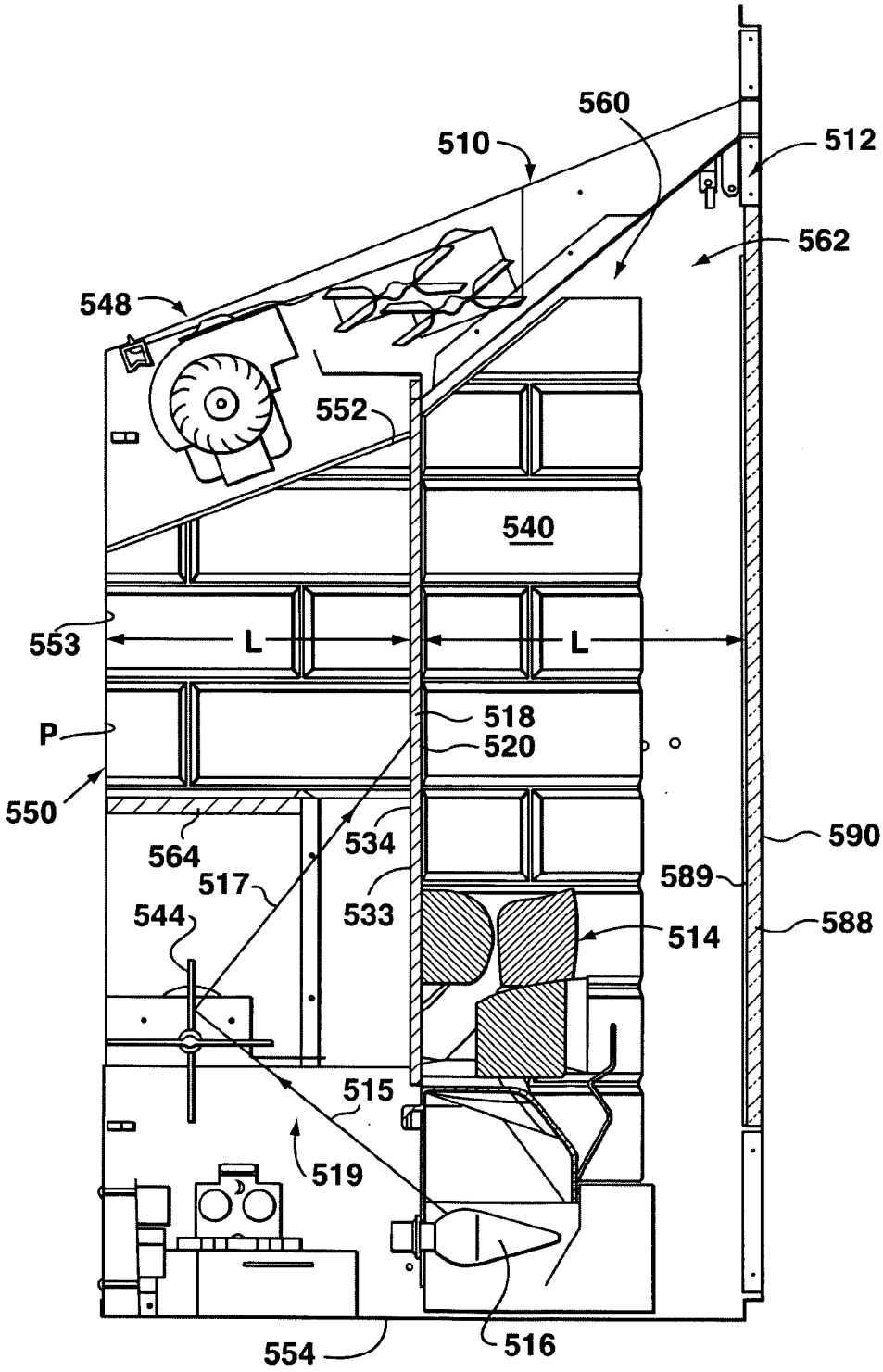
FIG. 19 is a cross-section of the flame simulating assembly of FIG. 15, drawn at a smaller scale.
Figure 20:
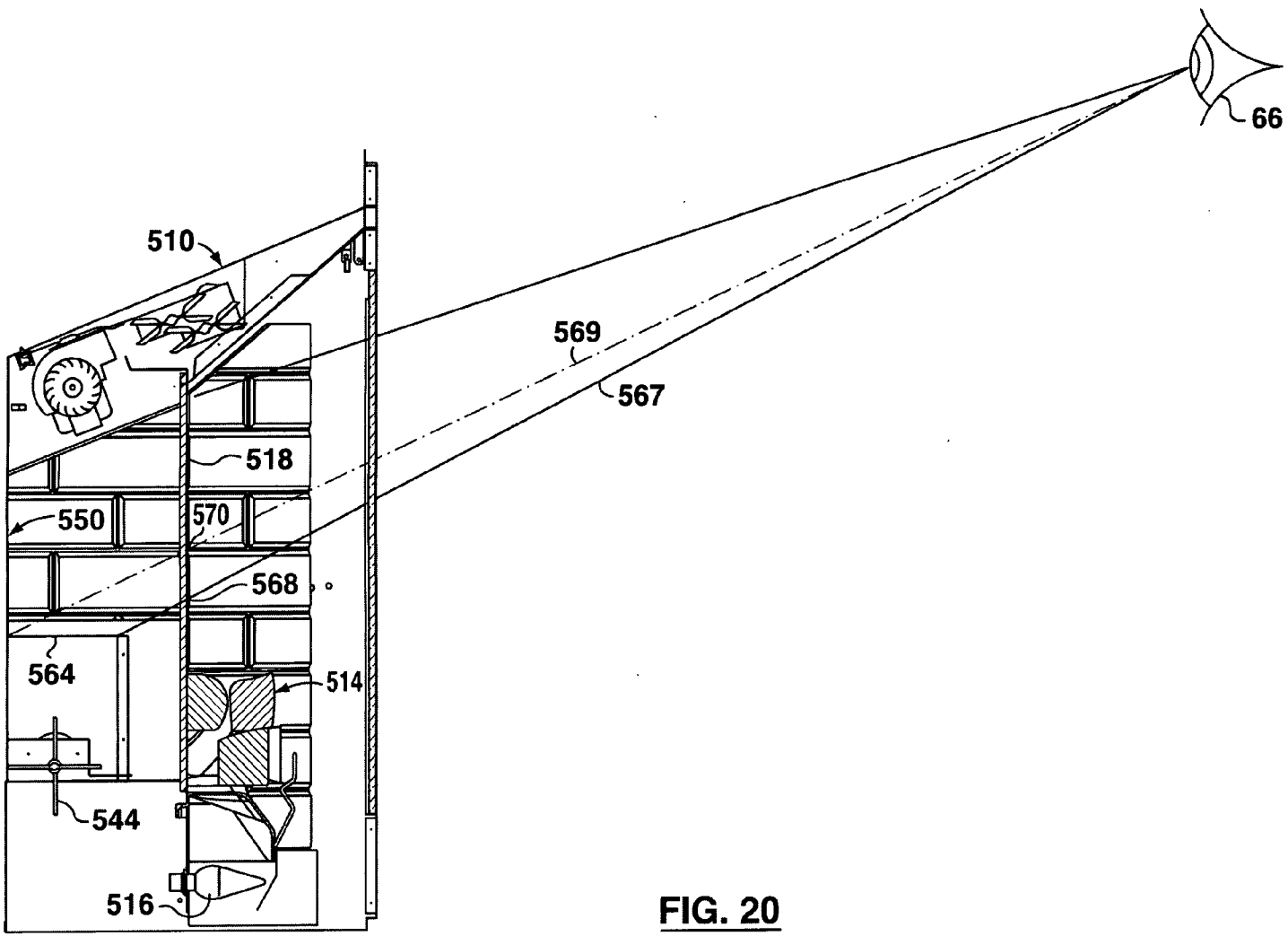
FIG. 20 is another cross-section of the flame simulating assembly of FIG. 15, drawn at a smaller scale.

Another embodiment of the flame simulating assembly 510 of the invention is shown in FIGS. 15-20. As can be seen in FIGS. 19 and 20, the flame simulating assembly 510 includes a substantially transparent front panel 588 having a rear side 589 and a front side 590 opposed thereto. Preferably, the flame simulating assembly 510 also includes a partially transparent screen 518 with a partially reflective front surface 520 and a rear surface 534 opposed thereto (FIG. 19). The front surface 520 is positioned to face the rear side 589 of the front panel 588, and is spaced apart therefrom by approximately a predetermined distance "L", as will be described. As can be seen in FIGS. 15 and 19, the front surface 520 of the screen is positioned substantially parallel to the rear side 589 of the front panel 588. The flame simulating assembly 510 also includes a number of first dots 592 (FIG. 16) which are disposed on the front panel 588 in a sufficiently consistent density over a given area to provide a substantially uniform tinted appearance to the front panel 588 when observed through the front side 590 in the manner disclosed in U.S. Pat. No. 6,050,011, the entire specification of which is incorporated herein by reference. Preferably, the front panel 588 also includes a number of second dots 594 (FIG. 16) which are substantially aligned with the first dots 592 and which face the front surface 520 of the screen 518, in the manner disclosed in U.S. Pat. No. 6,050,011. As can be seen in FIG. 16, the second dots 594 are smaller than the first dots 592. Preferably, the second dots 594 are arranged in a pattern 593 to define a first image 595 (as shown in FIG. 15) positioned for reflection by at least a part of the front surface 520 of the screen 518, to provide a virtual image 596 (as shown in FIG. 17) of the first image 595. The pattern 593 preferably is such that the first image 595 resembles firebrick, as will be described. The first image is substantially invisible to an observer looking through the front side of the front wall other than as a reflected image (i.e., the virtual image 596), reflected by a part of the front surface 520.

The flame simulating assembly 510 also includes a back wall 550 positioned behind the screen 518. Preferably, the back wall 550 displays a second image 551 on an exposed surface 553 thereof facing the rear surface 534 of the screen 518. The exposed surface 553 is spaced apart from the front surface 520 of the screen 518 by approximately the predetermined distance "L". Preferably, the exposed surface 553 substantially defines a plane "P", and it is also preferred that the exposed surface 553 is positioned substantially parallel to the front surface 520 of the screen 518 (FIG. 19). In addition, the second image 551 is at least partially observable through the front side 590 of the front panel 588. As a result of the structure of the flame simulating assembly 510 (as described above), the virtual image 596 is located substantially in the plane "P" of the exposed surface 553 (i.e., the same plane in which the second image 551 is located) so that the virtual image 596 appears to the observer to be positioned behind the screen 518, as will be described. Preferably, the surfaces involved—i.e., the exposed surface of the back wall 550; the front surface 520; and the rear side 589 of the front panel 588—are all substantially parallel to each other.

Figure 25:
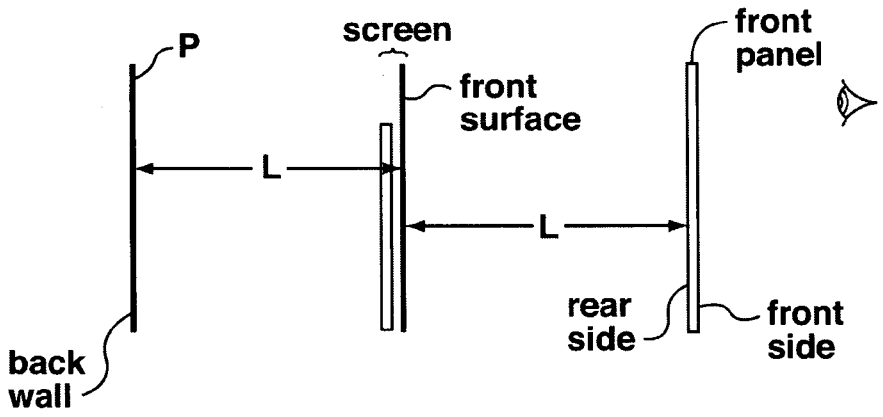
FIG. 25 is a schematic illustration showing the relationship between certain components of the flame simulating assembly of the invention.

The positioning of the back wall, the screen, and the front wall is also schematically illustrated in FIG. 25. The distance between the back wall and the front surface of the screen is substantially the same as the distance between the front surface of the screen and the rear side of the front panel. If the elements referred to are located accordingly, the virtual image is located in the same plane "P" as the second image, which second image is displayed on the back wall. If different distances separate the back wall from the front surface of the screen (on one hand) and the front surface of the screen from the rear side of the front panel (on the other hand), then the virtual image would not be presented in the same plane as the second image. It may be desirable in certain circumstances to achieve such a result.

As shown in FIG. 18, the front surface 520 of the screen 518 includes an observation region 530, which is adapted to permit observation of at least a portion of the exposed surface 553 of the back wall 550. The front surface 520 also includes a viewing region 528 (FIGS. 15, 17).

As can be seen in FIGS. 15, 17, 19 and 20, the flame simulating assembly 510 preferably includes a simulated fuel bed 514 which is positioned adjacent to the viewing region 528. In the preferred embodiment, the images of flames 11 are transmitted through the front surface 520 proximal to the simulated fuel bed 514, for a realistic flame simulation effect.

Preferably, the viewing region 528 is partially reflective. Because of this, the simulated fuel bed 514 is reflected in the viewing region 528 to an extent sufficient to provide an illusion of depth, as described in U.S. Pat. No. 5,642,580. U.S. Pat. No. 5,642,580 is hereby incorporated herein by reference. However, the images of flames 11 are also transmittable through the partially reflective viewing region 528. As can be seen in FIG. 17, the viewing region 528 is located proximal to the simulated fuel bed 514 so that, when images of flames 11 are transmitted through the screen 518, the images of flames 11 appear to be rising from and out of the simulated fuel bed 514, similar to flames in a real fire. At the same time, the back wall 550 (i.e., the exposed surface 553 thereof) is observable through an observation region 530, thereby simulating a firebox in a real fireplace (not shown) in which, e.g., wood or coal may be burned. The observation region 530 is preferably transparent or translucent, or at least partially transparent or translucent.

It is preferred that the front surface 520 of the screen 518 also includes a transition region 532 disposed between the viewing region 528 and the observation region 530. Preferably, the images of flames 11 are at least partially transmittable through the transition region 532, and the back wall 550 is also at least partially observable through the transition region 532. The transition region 532 is adapted to provide a relatively gradual transition from the viewing region 528 to the observation region 530, in order to provide a more realistic overall simulation effect. Preferably, if the viewing region 528 is partially reflective, then the transition region 532 is also partially reflective, however, to a somewhat lesser extent. To achieve this, the transition region 532 is preferably less silvered relative to the viewing region 528, as will be described.

In the preferred embodiment, the back surface 534 is adapted to diffuse light transmitted through the screen 518 to prevent an observer (not shown) from directly observing the light source 516, or other internal components of the flame simulating assembly 510, through the viewing region 548 and the transition region. Such a diffusing surface is described in U.S. Pat. No. 5,642,580. In the preferred embodiment of the flame simulating assembly 510, however, the back surface 534 of the screen 518 includes a diffusing portion 533 (not shown) which is located substantially opposite to the viewing region 528 and the transition region 532. The back surface 534 may also include a non-diffusing portion (not shown) which is located substantially opposite to the observation region 30.

Preferably, the diffusing portion 533 is divided into a first part (not shown) located opposite to the viewing region 528, and a second part (not shown) located opposite to the transition region 532. The extent to which light is diffused by the second part is somewhat less than the extent to which light is diffused by the first part. Because of this, the back wall 550 is at least partially observable through the transition region 532.

Preferably, the screen 518 is glass, plastic, or another other suitable material. In the preferred embodiment, the screen 518 is lightly silvered so that it is partially reflective, to provide a two-way mirror in the viewing region 528. The transition region 532 is preferably less silvered, and the observation region 530 preferably is not silvered. Within the transition region 532, the extent of reflective material on the front surface 520 varies from a relatively greater amount closer to the viewing region 528 to a relatively lesser amount closer to the observation region 530. This variation within the transition region 532 is to provide a gradual decrease in reflective material, from the viewing region 528 to the observation region 530, to enhance the simulation effect provided by the flame simulating assembly 510. The preferred method of producing the viewing region 528, the observation region 530, and the transition region 532 is described above, in connection with other embodiments of the present invention.

Alternatively, however, the screen 518 could be suitably tinted or otherwise treated in any suitable manner to provide the described simulation effect. For example, the screen could be tinted (i.e., with or without silvering on the front surface 520) to provide the viewing region 528 and the transition region 532, so that the viewing region 528 is darker than the transition region 532. The observation region 530 could also be lightly tinted or screened to achieve any desired effects, but still permitting relatively unobstructed observation therethrough.

An upper edge 529 of the viewing region 528 (which is also a lower edge of the transition region 532), is shown in FIG. 18. Also, an upper edge 531 of the transition region 532 (which is also a lower edge of the observation region 530) is shown in FIG. 18. It will be understood that, in the preferred embodiment, the regions 528, 532, and 530 are not sharply distinguished from each other. The edges 529, 531 are shown as clearly distinguished lines in the attached drawings for illustrative purposes only. In the preferred embodiment, the change from the viewing region 28 to the transition region 32 is gradual, and the change from the transition region 32 to the observation region 30 is also gradual, so that a distinct boundary in each case is not displayed.

As can be seen in FIGS. 15 and 17, it is also preferred that the back wall 550 has a pattern 536 simulating firebrick thereon (i.e., the pattern 536 being on the exposed surface 553), providing the second image 551. The firebrick pattern 536 preferably resembles firebrick in walls of a firebox in a real fireplace, and tends to enhance the overall simulation effect, as will be described.

Preferably, the flame simulating assembly 510 also includes a flame effect element 546, for configuring light from the light source 516 to form the image of flames 11. The flame effect element 546 is positioned in the path of light 19 (FIG. 19) from the light source 516 between the light source 516 and the screen 518. The flame effect element 546 can include one or more apertures (not shown) for configuring light passing through the apertures into the image of flames 11. It is preferred that the flame effect element 546 is similar to the flame effect element which is described in U.S. Pat. No. 6,363,636, the entire specification of which is hereby incorporated herein by reference.

In the preferred embodiment, the flame simulating assembly 510 also includes a flicker element 544 for causing light from the light source 516 to fluctuate, thereby enhancing the overall simulation effect. The flicker element 544 is positioned in the path of light 519 from the light source 516 between the light source 516 and the screen 518. Preferably, the flicker element 544 is similar to the flicker elements described in U.S. Pat. Nos. 5,642,580 and 6,363,636. The path of light 519 is schematically represented by arrows 513, 515, and 517 (FIG. 19).

It is also preferred that the flame simulating assembly 510 includes a housing 548 with the substantially vertical back wall 550, a top wall 552, a bottom wall 554, and at least two side walls 556, 558 extending between the top and bottom walls 552, 554, to at least partially define a cavity 560 therein. The cavity 560 has an opening 562 at a front end 512 of the housing 548, so that the cavity 560 is substantially viewable from the front by the observer. Preferably, the simulated fuel bed 514 is disposed in the cavity 560 proximal to the opening 562. The front panel 588 is preferably positioned in the opening 562. As shown in FIG. 19, the screen 518 is positioned behind the simulated fuel bed 514 and in front of the back wall 550.

As can be seen in FIGS. 17, 19, and 20, the flame simulating assembly 510 preferably also includes two simulated interior fireplace sidewalls 538, 540. Preferably, each of the simulated interior fireplace sidewalls 538, 540 extends from the back wall 550 forwardly beyond the front surface 520 of the screen 518 (FIGS. 19 and 20).

As indicated above, it is preferred that the pattern 536 on the back wall 550 simulates firebrick, e.g., such as would be seen in the firebox of a real fireplace. It is further preferred that the back wall 550 includes real firebrick, in order to provide a more realistic second image 551. Preferably, the simulated interior fireplace sidewalls 538, 540 also have patterns 542 simulating firebrick thereon. It is also preferred that the patterns 542 on the simulated interior fireplace sidewalls 538, 540 are substantially aligned with the pattern 536 on the back wall 550 (and hence also with the second image 551), to enhance the overall simulation effect provided by the flame simulating assembly 510. Preferably, the virtual image 596 is also aligned (i.e., congruent) with the patterns 536 and 542, as will be described.

Although the pattern 536 and the patterns 542 are simulated firebrick (FIGS. 17, 19, and 20), various patterns could be used on the back wall 550 and the interior sidewalls 538, 540. In order to achieve an effective simulation, the pattern 593 should be substantially the same as the patterns 536 and 542, so that the virtual image 596 and the image 551 are substantially congruent and aligned with the pattern 542. As will be appreciated by those skilled in the art, various patterns could be used to achieve different simulation effects.

In use, the flicker element 544 causes light from the light source 516 to fluctuate upon reflection thereof by the flicker element 544, similar to fluctuating light produced by a fire. In the preferred embodiment, light from the light source 516 reflected by the flicker element 544 and thereby caused to fluctuate, or flicker, is configured by the flame effect element 546 to form one or more images of flames 11 transmitted through the screen 518. The images of flames 11 appear to be rising from the simulated fuel bed 514, and the observer also can simultaneously observe the simulated back wall 550 and the side walls 538, 540. The transition region 532 provides a relatively gradual transition between the viewing region 528 and the observation region 530, to enhance the simulation effect.

Referring to FIG. 20, the eye 66 of an observer (not shown) is typically positioned so that a lower extent of the observer's field of vision (schematically represented by a line 567) intersects the screen 518 at 568. In FIG. 20, the lower edge 529 of the transition region 532 (i.e., the upper edge 529 of the viewing region 528) (FIG. 18) is preferably located approximately at 568 on the front surface 520 of the screen 518. Similarly, an approximate middle of the observer's field of vision (schematically represented by a line 569) intersects the screen 518 approximately at 570. In the preferred embodiment, the lower edge 531 of the observation region 530 (i.e., the upper edge 531 of the transition region 532) (FIG. 18) is preferably located approximately at 570 on the front surface 520 of the screen 518. The positioning of the edges 529, 531 of the regions 528, 530, 532 on the front surface 520 can be varied to suit the relative positioning of the screen 518 and the internal components in a flame simulating assembly 510, and in accordance with an assumed relative positioning (or range of positions) of the observer's eye(s).

The virtual image 596 is viewable by the observer due to the reflection of the first image 595 in the viewing region 528 (and to an extent, in the transition region 532). The observer simultaneously views the second image 551 through the observation region 530 and, to an extent, also through the transition region 532. As indicated above, the patterns in the virtual image 596 and the second image 551 are congruent and aligned with each other. The virtual image 596 also appears to be located in the plane "P", i.e., the plane substantially defined by the front surface of the back wall, to enhance the simulation of a firebrick wall positioned behind the image of flames 11.

If preferred, the flame simulating assembly 510 optionally includes a shield 564, for obstructing light from the light source 516 which is directed to the vicinity of the observation region 530 or for concealing certain components. The shield 564 is preferably positioned behind the screen 518 and below the transition region 532 and beside or below the transition region 532. As can be seen in FIG. 20, the observer's eye 66 observing the flame simulating assembly 510 is typically positioned so that the observer cannot observe the flame effect element 546 or other components positioned behind the screen 518 directly. However, it is possible that an observer (not shown) could be positioned so as to view some of the internal components (such as the flicker element 544, or the flame effect element 546) directly, or light from the light source 516 directed to the observation region 530 may distract the observer. In either or both of these circumstances, it may be advantageous to include the shield 564 in the flame simulating assembly 510.

However, it has been found that, if the components are positioned appropriately relative to each other and relative to the observation region 530 and the transition region 532, the shield 564 may not be necessary. As can be seen in FIG. 20, the positioning of the flame effect element 546 and the flicker element 544 relative to the transition region 532 and the observation region 30 can affect the effectiveness of the simulation provided by the flame simulating assembly 510. The flame effect element 546 and the flicker element 544 are preferably not positioned where the ordinarily located observer would be able to observe these components directly through the transition region 532 or the observation region 530.

From the foregoing, it can be seen that the virtual image 596 and the second image 551 preferably are positioned and formed to be substantially congruent, or aligned with each other, so that the virtual image 596 and the second image 551 appear to be substantially continuous relative to each other. Also, the pattern 542 on the sidewalls 538, 540 is preferably aligned with the pattern 536.

As disclosed in the attached Figures, the first image 595 and the second image 551 preferably are representations of firebrick arranged in a brick wall. It will be understood that the second image 551 could be created, for example, by providing the back wall 550 which is (in whole or in part) a brick wall with real firebricks, positioned so that they are substantially congruent with the firebrick images in the virtual image 596. Using real firebricks in the back wall 550 is preferred because it provides a more realistic effect.

Preferably, the exposed surface 553 is at least partially observable through the observation region 530 of the screen 518 from the front side 590 of the front panel 588.

Figure 21:
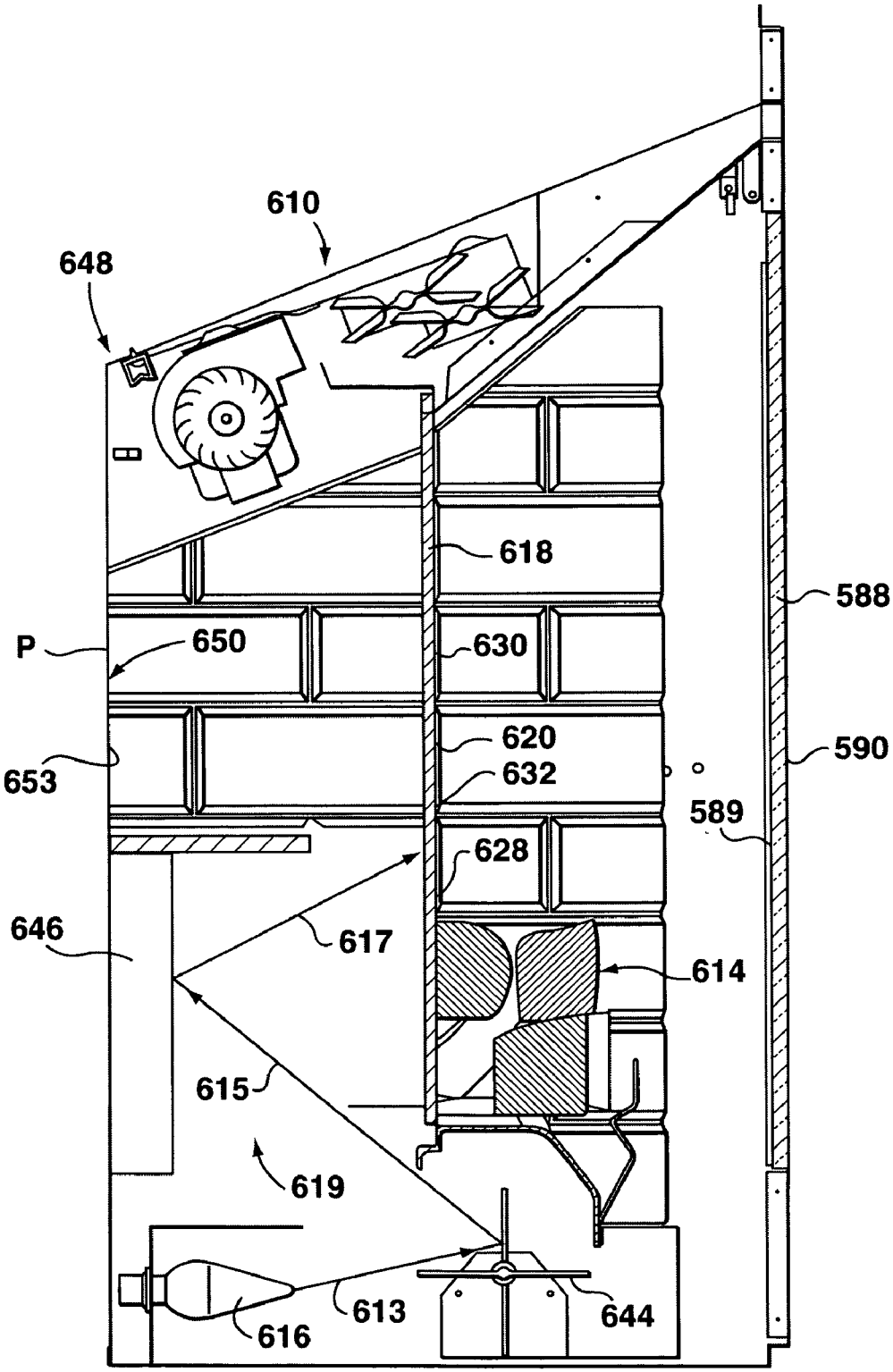
FIG. 21 is a cross-section of an alternative embodiment of the flame simulating assembly of the invention, drawn at a larger scale.
Figure 22:
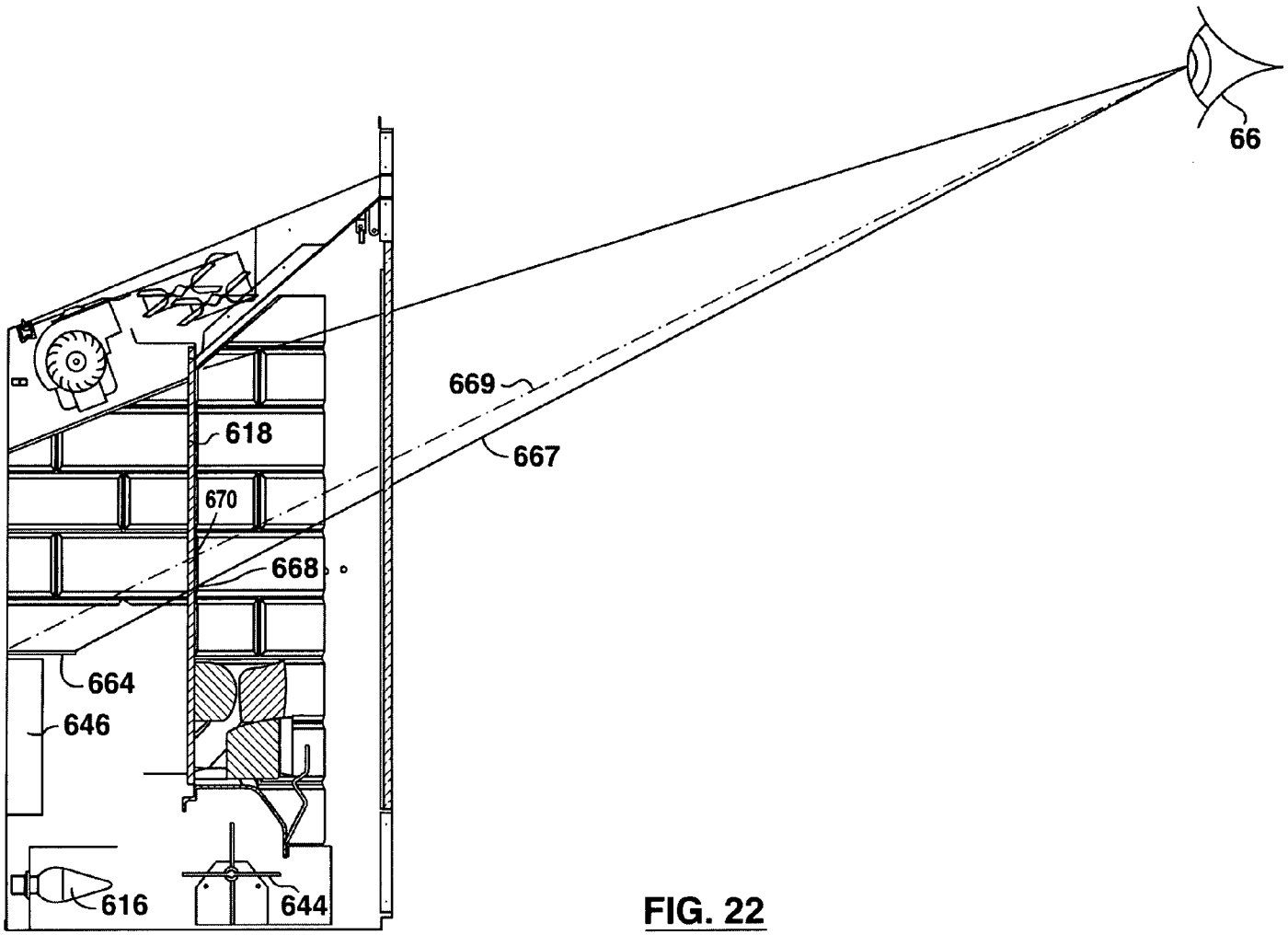
FIG. 22 is another cross-section of the flame simulating assembly of FIG. 21 drawn at a smaller scale.

Another alternative embodiment of a flame simulating assembly 610 of the invention is shown in FIGS. 21 and 22, a flicker element 644 is positioned substantially underneath the simulated fuel bed 614. The flame simulating assembly 610 includes the housing 648, and a flame effect element 646 is mounted on or positioned proximal to a back wall 650 of the housing 648. The flame effect element 646 is substantially reflective, and is preferably formed in the shape of flames, for configuring light reflected from the flicker element 644 to resemble flames. Preferably, the flame effect element 646 is similar to the flame effect element disclosed in U.S. Pat. Nos. 6,564,485. 6,564,485 is hereby incorporated herein by reference. Also, however, an exposed surface 653 of the back wall 650 preferably provides a firebrick pattern, viewable through a front side 590 of the front panel 588.

The flicker element 644 is positioned in a path of light 619 between the light source 616 and the screen 618. Similarly, the flame effect element 646 is positioned in the path of light 619 between the light source 616 and the screen 618. The path of light 619 is schematically represented by arrows 613, 615, and 617 (FIG. 21).

Preferably, the screen 618 in the flame simulating assembly 610 has a front surface 620 which includes the viewing region 628, an observation region 630, and a transition region 632. The flicker element 644 causes light from the light source 616 to fluctuate upon reflection thereof by the flicker element 644. Light from the light source 616 which is reflected by the flicker element 644 and thereby caused to fluctuate, or flicker, is configured by the flame effect element 646 to form one or more images of flames transmitted through the screen 618. The images of flames appear to be rising from the simulated fuel bed 614, and the observer also can simultaneously observe the back wall 650. The transition region 632 provides a relatively gradual transition between the viewing region 628 and the observation region 630, to enhance the simulation effect. The positioning of the flicker element 644 substantially underneath the simulated fuel bed 614, and the positioning of the at least partially reflective flame effect element 646 proximal to, or on the back wall 650, results in an enhanced simulation effect.

As can be seen in FIGS. 21 and 22, the flame simulating assembly 610 includes the front panel 588 positioned in front of the screen 618. The back wall 650 is positioned a predetermined distance from the front surface 620 of the screen 618, and the front surface 620 is spaced apart from the rear side 589 of the front panel 588 by the same predetermined distance. The panel 588 includes a number of first dots (as in FIG. 16) and a number of second dots (as in FIG. 16) positioned on the first dots, as described above. Accordingly, the second dots are arranged in a pattern (not shown) to define a first image (not shown) positioned for reflection by the front surface 620 of the screen 618, to provide a virtual image of the first image.

More specifically, the first image is reflected by the viewing region 628 and, to an extent, by the transition region 632. The observer simultaneously views a second image on an exposed surface 653 on the back wall 650 through the observation region 630 of the screen 618 (and, to an extent, also through the transition region 632). The virtual image and the pattern on the back wall 650 are congruent and aligned with each other. The virtual image also is located in the plane "P" substantially defined by the exposed surface 653 of the back wall 650, thereby enhancing the simulation of a firebrick wall positioned behind the images of flames. As shown in FIGS. 21 and 22, the flame simulating assembly 610 preferably includes side walls with patterns thereon which are also substantially aligned with the virtual image and the pattern provided on the back wall 650, to further enhance the simulation effect.

Referring to FIG. 22, the eye 66 of an observer (not shown) is typically positioned so that a lower extent of the observer's field of vision (schematically represented by a line 667) intersects the screen 618 at 668. In FIG. 22, the lower edge of the transition region 632 (i.e., the upper edge 629 of the viewing region 628) is preferably located substantially at 668 on the front surface 620 of the screen 618. Similarly, an approximate middle of the observer's field of vision (schematically represented by a line 669) intersects the screen 618 at 670. In the preferred embodiment, the lower edge of the observation region 630 (i.e., the upper edge of the transition region 632) is preferably located on the front surface 620 of the screen 618. The positioning of the edges of the regions 628, 630, 632 on the front surface 620 can be varied to suit the relative positioning of the screen 618 and the internal components in a flame simulating assembly 610, and in accordance with an assumed relative positioning (or range of positions) of the observer.

If preferred, the flame simulating assembly 610 optionally includes a shield 664, for obstructing light from the light source 616 which is directed to the vicinity of the observation region 630 or for concealing certain components. The shield 664 is preferably positioned behind the screen 618 and beside or below the transition region 632 (FIGS. 21, 22). As can be seen in FIG. 22, the observer's eye 66 observing the flame simulating assembly 610 is typically positioned so that the observer cannot observe the flame effect element 646 or other components positioned behind the screen 618 directly. However, it is possible that an observer (not shown) could be positioned so as to view some of the internal components (such as the flicker element 644, or the flame effect element 646) directly, or light from the light source 616 directed to the observation region 630 may distract the observer. In either or both of these circumstances, it may be advantageous to include the shield 664 in the flame simulating assembly 610.

However, it has been found that, if the components are positioned appropriately relative to each other and relative to the observation region 630 and the transition region 632, the shield 664 is generally not necessary. As can be seen in FIG. 22, the positioning of the flame effect element 646 and the flicker element 644 relative to the transition region 632 and the observation region 630 can affect the effectiveness of the simulation provided by the flame simulating assembly 610. The flame effect element 646 and the flicker element 644 are preferably not positioned where the ordinarily located observer would be able to observe these components directly through the transition region 632 or the observation region 630.

Figure 23:
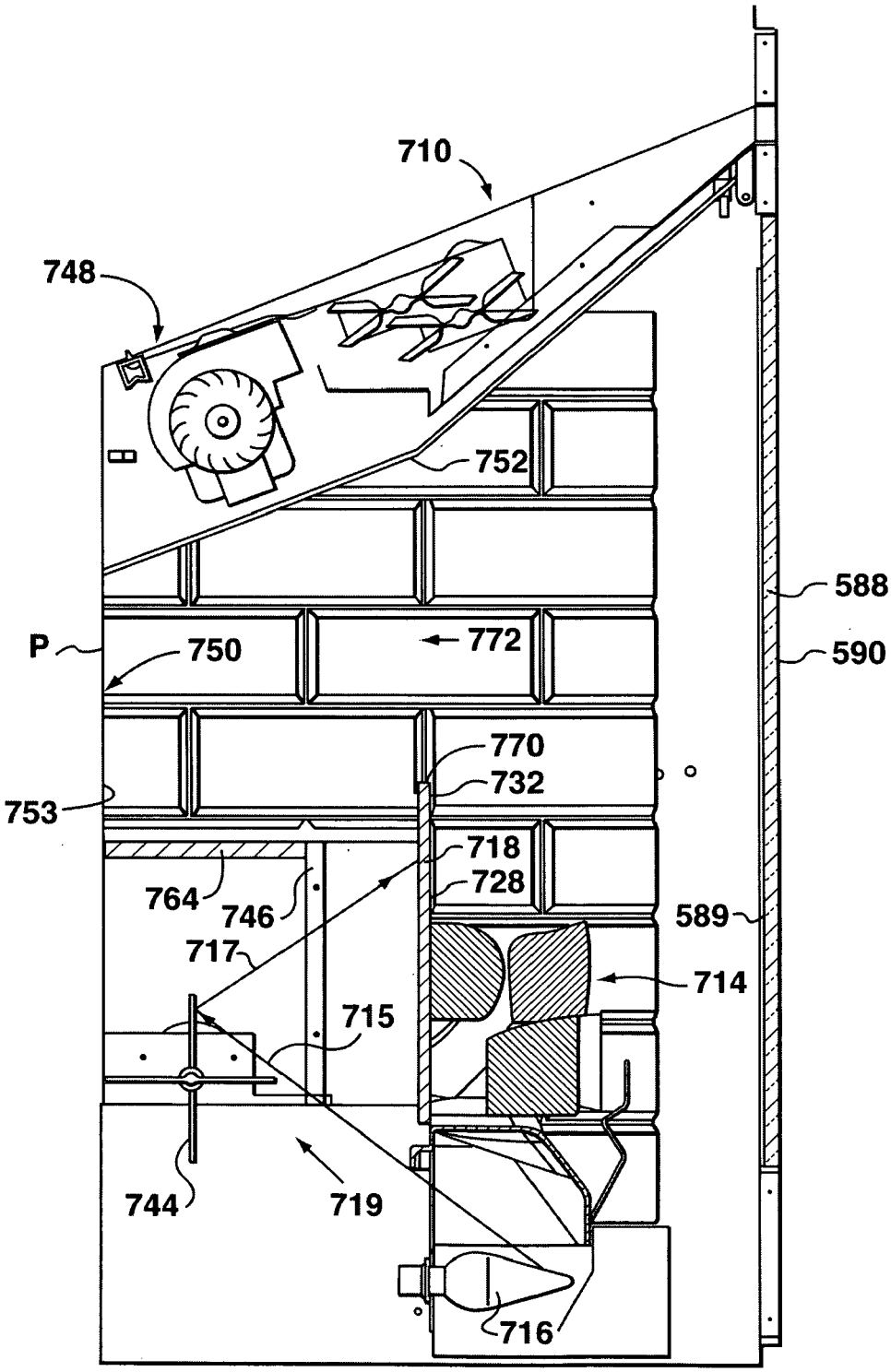
FIG. 23 is a cross-section of another alternative embodiment of the flame simulating assembly of the invention, drawn at a larger scale.

As shown in FIG. 23, another embodiment of the flame simulating assembly 710 of the invention additionally includes a housing 748 in which the screen 718 is positioned. In one embodiment, the screen 718 has a top edge 770 spaced apart from a top wall 752 of the housing 748 to define an upper opening 772 so that the exposed surface is at least partially observable through the front side 590 of the front panel 588 and the upper opening 772. In addition to the top wall 752, the housing 748 includes a back wall 750 behind the screen 718. Preferably, the housing 748 also includes side walls extending forward from the back wall 750 beyond the screen 718, with a firebrick pattern thereon to enhance the simulation effect. A simulated fuel bed 714 is positioned in front of the screen 718.

As can be seen in FIG. 23, the flame simulating assembly 710 also includes a light source 716, a flicker element 744 positioned in a path of light 719 (schematically represented by arrows 715, 717), and a flame effect element 746, also positioned in the path of light 719. The flame effect element 746 is for configuring light from the light source 716 into one or more images of flames 11 which are transmitted through the screen 718. The flicker element 744 is for causing light from the light source to flicker or fluctuate, thereby enhancing the overall simulation effect.

As can also be seen in FIG. 23, substantially unobstructed observation is permitted through the upper opening 772, so that part of the back wall 750 is observable. Also, parts of the side walls are observable through the opening 772. Because this is similar to the substantially unobstructed observation of a firebox which may be enjoyed by an observer of a real fireplace (i.e., one in which wood or coal may be burned), the upper opening 772 tends to enhance the overall simulation effect.

FIG. 23 also shows that the front panel 588 is positioned in front of the screen 718. The back wall 750 is positioned a predetermined distance from the front surface 720 of the screen 718, and the front surface 720 is spaced apart from the rear side 589 of the front panel 588 by the same predetermined distance. The panel 588 includes a number of first dots (as in FIG. 16) and a number of second dots (as in FIG. 16) positioned on the first dots, as described above. Accordingly, the second dots are arranged in a pattern (not shown) to define a first image (not shown) positioned for reflection by the front surface 720 of the screen 718, to provide a virtual image of the first image.

More specifically, the first image is reflected by the viewing region 728 and, to an extent, by the transition region 732. The observer simultaneously views a second image on an exposed surface 753 on the back wall 750 through the opening 772 (and, to an extent, also through the transition region 732). The virtual image and the pattern on the back wall 750 are congruent and aligned with each other. The virtual image also is located in the plane "P" substantially defined by the exposed surface 753 of the back wall 750, thereby enhancing the simulation of a firebrick wall positioned behind the images of flames. As shown in FIG. 23, the flame simulating assembly 710 preferably includes side walls with patterns thereon which are also substantially aligned with the virtual image and the pattern provided on the back wall 750, to further enhance the simulation effect.

Optionally, a shield 774 (shown in FIG. 23) may be included in the flame simulating assembly 710. The shield 774 is for obstructing light from the light source 716 which may be directed above the top edge 770 of the screen 718 or for concealing certain components. The shield 774 is preferably positioned behind the screen 718 and beside or below the transition region 732. It is possible that the observer could be positioned so as to view some of the internal components (such as the flicker element 744, or the flame effect element 746) directly, or light from the light source 716 directed above the top edge 770 of the screen 718 may distract the observer. In either or both of these circumstances, it may be advantageous to include the shield 774 in the flame simulating assembly 710.

Preferably, the screen 718 includes a viewing region 728 and a transition region 732 disposed at least partially between the viewing region 728 and the top edge 770. In the preferred embodiment, the viewing region 728 is partially reflective, although the images of flames 11 are also transmittable through the viewing region 728. The transition region 732 preferably extends from the viewing region 728 to the top edge 770. The transition region 732 is preferably lightly silvered (and therefore also partially reflective), so that the back wall 750 is at least partially viewable through the transition region 732. A back surface 734 of the screen 718 diffuses light from the light source 716, also to enhance the overall simulation effect. Also, however, the images of flames 11 are partially observable through the transition region 732.

Alternatively, the viewing region 732 is translucent. For example, the screen 718 could be suitably tinted glass or plastic (or other suitable material) through which the image of flames 11 is transmittable. The transition region 732 also could be suitably tinted, to enhance the overall simulation effect.

Alternatively, the front surface 720 may also include one or more observation regions 730, generally disposed between the transition region 732 and the top edge 770. Also, it will be understood that the top edge 770 may be curved, or substantially horizontal. If curved, for example, the top edge may define a screen (not shown) which is generally semi-circular, to provide a front surface which is sufficiently large to accommodate the image of flames 11 which is commensurate with the simulated fuel bed 714.

It has been found that, if the internal components are positioned appropriately relative to each other and relative to the transition region 732 and the top edge 770, the shield 774 is generally not necessary. The flame effect element 746 and the flicker element 744 are preferably not positioned where the ordinarily located observer would be able to observe these components directly through the transition region 732 or the upper opening 772.

Figure 24:
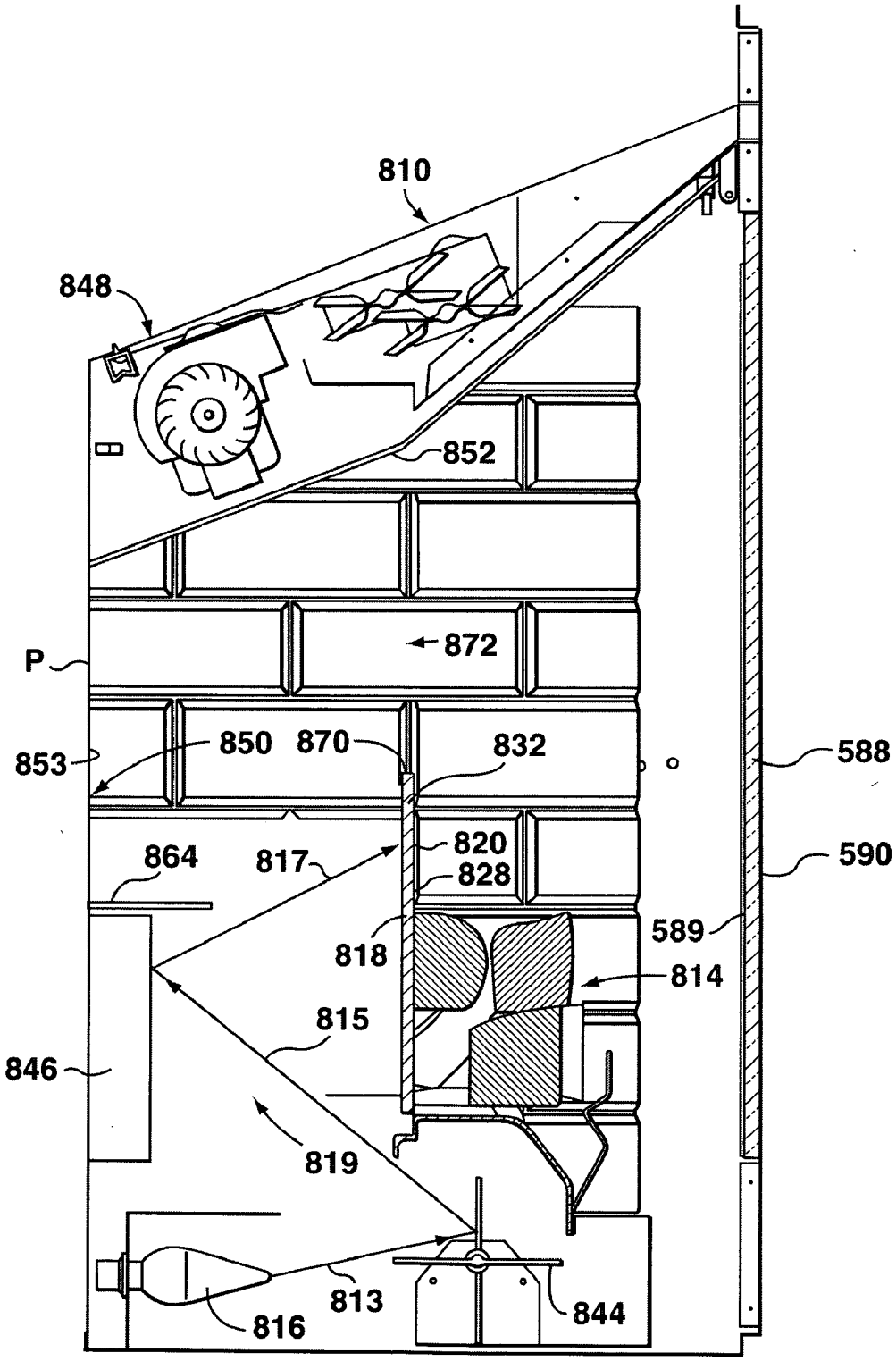
FIG. 24 is a cross-section of another alternative embodiment of the flame simulating assembly of the invention.

Another alternative embodiment of a flame simulating assembly 810 of the invention, shown in FIG. 24, includes a screen 818 which is similar to the screen 718. In the flame simulating assembly 810, a flicker element 844 is positioned substantially underneath the simulated fuel bed 814. The flame simulating assembly 810 includes a housing 848, and a flame effect element 846 is mounted on or positioned proximal to a back wall 850 included in the housing 848. The flame effect element 846 is preferably reflective (or substantially reflective), and is preferably formed in the shape of flames. Preferably, the flame effect element 846 is similar to a flame effect element disclosed in U.S. Pat. No. 6,564,485. Also, however, an exposed surface 853 of the back wall 850 preferably provides a firebrick pattern.

The screen 818 has a top edge 870 spaced apart from a top wall 852 of the housing 848 to define an upper opening 872 through which the exposed surface 853 is viewable by the observer through the front side 590 of the front panel 588 and the opening 872. Preferably, the flame simulating assembly 810 also includes side walls extending forward from the back wall 850 beyond the screen 818 with a firebrick pattern thereon, to enhance the simulation effect.

The flicker element 844 is positioned in a path of light 819 between the light source 816 and the screen 818. Also, the flame effect element 846 is positioned in the path of light 819 between the light source 816 and the screen 818. The path of light 819 is schematically represented by arrows 813, 815, and 817 (FIG. 24).

As can be seen in FIG. 24, the flame simulating assembly 810 includes the front panel 588 positioned in front of the screen 818. The back wall 850 is positioned a predetermined distance from the front surface 820 of the screen 818, and the front surface 820 is spaced apart from the rear side 589 of the front panel 588 by the same predetermined distance. The panel 588 includes a number of first dots (as in FIG. 16) and a number of second dots (as in FIG. 16) positioned on the first dots, as described above. Accordingly, the second dots are arranged in a pattern (not shown) to define a first image (not shown) positioned for reflection by the front surface 820 of the screen 818, to provide a virtual image of the first image.

More specifically, the first image is reflected by the viewing region 828 and, to an extent, by the transition region 832. The observer simultaneously views a second image on an exposed surface 853 on the back wall 850 through the opening 872 (and, to an extent, also through the transition region 832). The virtual image and the pattern on the back wall 850 are congruent and aligned with each other. The virtual image also is located in the plane "P" substantially defined by the exposed surface 853 of the back wall 850, thereby enhancing the simulation of a firebrick wall positioned behind the images of flames. As shown in FIG. 24, the flame simulating assembly 810 preferably includes side walls with patterns thereon which are also substantially aligned with the virtual image and the pattern provided on the back wall 850, to further enhance the simulation effect.

As described above in connection with the screen 718, the screen 818 may alternatively include an observation region 830. Also, the top edge 870 may be curved, or substantially horizontal.

The positioning of the flicker element 844 substantially underneath the simulated fuel bed 814, and the positioning of the flame effect element 846 proximal to or on the back wall 850, results in an enhanced simulation effect. Preferably, the flame simulating assembly 810 includes a shield 864 for obstructing light from the light source directed above the screen 818.

It will be evident to those skilled in the art that the invention can take many forms, and that such forms are within the scope of the invention as claimed. Therefore, the spirit and scope of the appended claims should not be limited to the descriptions of the versions contained herein.

We claim:

1. An assembly comprising:

a substantially transparent front panel having a rear side and a front side opposed thereto;

a partially translucent screen with a partially reflective front surface and a rear surface opposed thereto, the front surface being positioned to face the rear side of the front panel and being spaced apart therefrom by a predetermined distance;

the front surface of the screen being positioned substantially parallel to the rear side of the front panel;

a plurality of first dots disposed on the front panel in a sufficiently consistent density over a given area to produce a substantially uniform tinted appearance to the front panel when observed through the front side;

a plurality of second dots disposed on the first dots and facing said front surface of the screen, said second dots being smaller than said first dots;

said second dots defining a first image for reflection by at least part of said front surface of the screen to provide a virtual image of the first image;

a back wall positioned behind the screen, the back wall displaying a second image on an exposed surface thereof facing the rear surface of the screen, the exposed surface being spaced apart from the front surface of the screen by the predetermined distance, the exposed surface substantially defining a plane;

the exposed surface of the back wall being positioned substantially parallel to the front surface of the screen;

the second image being at least partially observable through the front side of the front panel; and the virtual image being located substantially in the plane of the exposed surface such that the virtual image appears to be positioned behind the screen.

2. An assembly according to claim 1 in which the virtual image and the second image are substantially aligned with each other such that the virtual image and the second image appear to be substantially continuous relative to each other.

3. An assembly according to claim 2 in which the first image and the second image comprise representations of firebrick arranged in a brick wall.

4. An assembly according to claim 1 in which the screen comprises an observation region through which the exposed surface is at least partially observable from the front side of the front panel.

5. An assembly according to claim 1 additionally comprising a housing in which the screen is disposed, and the screen comprises a top edge spaced apart from a top wall of the housing to define an upper opening such that the exposed surface is at least partially observable through the front side of the front panel and the upper opening.

6. An assembly according to claim 1 in which the exposed surface is at least partially observable over a top edge of the screen and through the front side of the front panel.

7. An assembly according to claim 1 additionally comprising:

a flame image subassembly for providing at least one image of flames;

a simulated fuel bed positioned in front of the front surface of the screen;

the front surface comprising:

a viewing region disposed proximate to the simulated fuel bed through which said at least one image of flames is transmittable; and an observation region disposed distal to the simulated fuel bed, the observation region being adapted to permit at least partial observation of the back wall from the front side of the front panel.

8. An assembly according to claim 7 in which the front surface of the screen comprises a transition region disposed between the observation region and the viewing region, the exposed surface being at least partially observable through the transition region.

9. A flame simulating assembly for providing at least one image of flames, the flame simulating assembly comprising:

a housing comprising a back wall with a substantially planar exposed surface, the housing defining a cavity open at a front end of the housing;

a screen disposed in the cavity and in front of the back wall, the screen comprising a front surface adapted for transmitting said at least one image of flames therethrough, the front surface being at least partially reflective and being positioned substantially parallel to the exposed surface of the back wall;

a flame image subassembly for providing said at least one image of flames;

a substantially transparent front panel disposed substantially at the front end of the housing and comprising a front side and an opposed rear side;

the rear side of the front panel facing the front surface of the screen and being spaced a predetermined distance apart from the front surface of the screen;

the rear side of the front panel being positioned substantially parallel to the front surface of the screen;

the front panel comprising:

a plurality of first dots disposed on said front panel in a sufficiently constant density over a given area to produce a substantially uniform tinted appearance to said front panel when observed through said front side;

a plurality of second dots disposed on said first dots and facing said front surface of the screen;

a first image defined by said second dots, said first image being substantially invisible when observed through the front side other than as a virtual image thereof reflected by the front surface of the screen;

the exposed surface of the back wall displaying a second image at least partially observable through the front side of the front panel, the exposed surface being spaced apart from the front surface of the screen by the predetermined distance; and the virtual image being located substantially in the plane of the exposed surface such that the virtual image appears to be positioned behind the screen.

10. A flame simulating assembly according to claim 9 in which the screen comprises at least one observation region permitting at least partial observation of the exposed surface through said front side of the front panel.

11. A flame simulating assembly according to claim 10 in which the screen comprises a viewing region through which said at least one image of flames is transmittable.

12. A flame simulating assembly according to claim 11 in which the screen comprises a transition region disposed between the observation region and the viewing region, the exposed surface being at least partially observable through the transition region.

13. A flame simulating assembly according to claim 9 in which the first image and the second image are representations of a firebrick wall.

14. A flame simulating assembly according to claim 9 in which the second image is provided by firebrick comprising the back wall.

15. A flame simulating assembly according to claim 14 in which the firebrick comprises a plurality of surfaces with at least one preselected texture.

16. A flame simulating assembly according to claim 9 in which the screen comprises a top edge which is spaced apart from a roof portion of the housing by a preselected distance to define an upper opening permitting observation of at least part of the exposed surface through said front side of the front panel.

17. An assembly for providing an optical illusion comprising:

a substantially transparent front panel having a rear side and a front side;

an at least partially translucent screen positioned substantially vertically, the screen comprising a front surface and a rear surface opposed thereto, the front surface facing the rear side of the front panel;

the rear side of the front panel being spaced apart from the front surface of the screen by a predetermined distance;

a back wall positioned behind the screen comprising a plurality of objects collectively providing a substantially planar exposed surface thereof facing the rear surface of the screen, the exposed surface being spaced apart from the front surface of the screen by the predetermined distance;

the front panel comprising:

a plurality of first dots disposed on said front panel in a sufficiently constant density over a given area to produce a substantially uniform tinted appearance to said front wall when observed through said front side, each said first dot having a preselected area;

a plurality of second dots positioned on said first dots and facing said front surface of the screen, said second dots defining a first image for reflection by the front surface of the screen to create a virtual image of the first image;

the exposed surface of the back wall being at least partially observable through the front side of the front panel; and the virtual image being located substantially in the plane of the exposed surface, such that the virtual image appears to be located behind the screen.

18. An assembly according to claim 17 in which the virtual image and the objects comprising the exposed surface appear to be substantially continuous relative to each other.

19. An assembly according to claim 17 additionally comprising:

a viewing region positioned on the front surface of the screen;

a flame image subassembly for providing at least one image of flames at least partially transmittable through the viewing region; and the screen comprising an observation region through which the exposed surface is at least partially observable.

20. An assembly according to claim 19 in which the screen comprises a transition region disposed between the observation region and the viewing region, and the exposed surface is at least partially observable through the transition region.

21. An assembly according to claim 17 in which the objects comprise firebricks forming a brick wall.

* * * * *